United States Patent [19]

Russell

[11] 4,392,599

[45] Jul. 12, 1983

[54] DRAWER BUILDING SYSTEM HAVING FASTENING GUNS

[76] Inventor: B. Carson Russell, 8137 Chateau Dr., Cherry Bluffs Estate, Egg Harbor, Wis. 54209

[21] Appl. No.: 179,728

[22] Filed: Aug. 20, 1980

[51] Int. Cl.[3] ..... B27M 3/34; B31B 13/60

[52] U.S. Cl. ..... 227/40; 227/111; 227/152

[58] Field of Search ..... 227/40, 110, 111, 152; 144/2 C, 3 L

[56] References Cited

U.S. PATENT DOCUMENTS

| | | | |
|---|---|---|---|
| 3,100,301 | 8/1963 | Black | 227/152 |
| 3,559,863 | 2/1971 | Sack et al. | 227/152 |
| 3,734,111 | 5/1973 | Abernathy | 227/111 |
| 3,765,587 | 10/1973 | Davis | 227/152 |

*Primary Examiner*—Gil Weidenfeld
*Assistant Examiner*—Fred A. Silverberg
*Attorney, Agent, or Firm*—Hiram A. Sturges

[57] ABSTRACT

A building machine, useful for building drawers and other products, having first and second carriages, sub-carriages moveably mounted on the carriages, a work-piece space between the carriages during building, fastening guns, first and second sets of spaced shiftable gun holders carrying the guns and disposed on first and second sides of the work-piece space, gun holder mounting assemblies movably mounting the gun holders on the sub-carriages, all movements being in a manner whereby the guns are positionable by adjustment with respect to the work-piece space in three dimensions, the guns being for driving staples, brads, pins, or nails.

1 Claim, 28 Drawing Figures

DRAWER BUILDING SYSTEM HAVING FASTENING GUNS

BACKGROUND OF THE INVENTION

A major objective of this invention is to provide a drawer building machine which is as automatic as can be in its operation when working with the various drawer styles.

Drawers are designed in many styles. One style is a drawer in which the front has two recesses spaced inwardly from the ends that receive the sides in which case the sides are secured in my machine by staples diagonally driven through the sides into the front from the rear side of the front. The rearward side of such a drawer is received in notches on the inner sides of the sides at the rearward ends, these notches opening also on the rearward ends of the sides, as distinguished from the notches in the front, which only open rearwardly. The rear panel in such a drawer is received in the notches and the staples are driven at a 90 degree angle through the sides into the rear panel.

The bottom of the drawer is first slid into place between the sides and into a groove at the front, such bottom receiving grooves being normally adequate to hold the bottom in place, in addition to a similar groove at the bottom of a rearward side of the drawer which receives the back side of the bottom piece.

One of my concepts is to build a drawer in a machine with the front piece of the drawer facing downwardy, the sides extending vertically and put into place just before the manually sliding therebetween of a bottom piece and preceding the placement of the rear side piece of the drawer. I conceive that in this way of making the drawer the back piece is held in place by gravity before it is stapled in place, which leads to a possibility of an operator finding it simple to reach to the position in which he must slide the bottom piece in place, as contrasted to machines of the prior art in which the drawer is positioned in the machine with the bottom of the drawer downward so that the operator then must reach across the front side piece of the drawer clear to the rearward side of the drawer and awkwardly push the bottom piece in place by shoving it toward his stomach forwardly into the machine toward the front piece of the drawer.

An objective of my machine is to hold the drawer in a position so that the entire drawer is at a minimum distance from the operator's position at the front of the machine so that everything can be easily reached. This means that as the machine establishes positions for parts, the operator can manually put the parts in place very simply and with a minimum of reaching and stretching.

It is true that in the prior art there have been machines in which the front of the drawer is disposed rearwardly in the machine, whereby when the operator manually slides the bottom of the drawer in place he can push it in from the front side which in itself is not a disadvantage, but there is a great disadvantage at the earlier stage in which the front piece of the machine must be manually positioned by the operator by reaching deep down into the machine toward the rearward side of the machine to put the front piece to the rear of the machine in the first place, a reaching and stretching which I propose to avoid for advantages of speed of operation, and less tiring out of the operator.

Another disadvantage of the above described prior art type of drawer building machine is that when the front piece is at the rear of the machine the inevitable result is that the back piece of the drawer is then at the front of the machine and extra mechanism is required to support it; whereas, in my machine this first drawer style can be made with the advantage that the back piece of the drawer is vertically supported by notches in the sides of the drawer by gravity alone and without special mechanism.

A second drawer style is the one I make by placing the front of the drawer at the lower position in the machine, a characteristic of the making of all drawers in my machine, the front of the drawer in this second style having notches that open toward the rearward side of the front and also toward its ends, receiving therein the forward ends of the side pieces of the drawer with the rear side of the drawer put in place last. But in this style of drawer there are no notches at the rear of the side pieces of the drawer to receive the back piece and I provide pneumatic mechanism to support the rearward edge of the back side piece of the drawer from falling downward during stapling, the forward side of the back piece of the drawer, as it is seen in the machine, being supported by the bottom piece of the drawer previously put into place and needing no mechanical supportt. This is contrasted with the prior art because the underside of the drawer back piece needs to be supported only from its underside since gravity alone is sufficient to hold it in place on its upper side in the machine, as contrasted with the placement of pieces in the prior art in which a back piece must be supported from what will later be the inner side of the back piece and also in addition from what will later be the back side of the back piece in order to keep it from tipping over.

A third style of drawer has side walls and a bottom piece that make a box having one side open that will later be the top of the drawer, and a drawer front piece is later added to this box, which is fixed to the front piece of the box as a later step. Such drawers are used in the prior art because such a "drawer box" can be made in quantity and then various lengths and widths of the front piece can be added to them as desired for different articles of furniture.

In making the drawer of this third style in my machine the front piece to be later added is not present in the machine at all, by my concept, and in its place a mock front piece is placed in the machine as a temporary size gauge for the machine to sense the later position of a front piece from, so that all the parts of the "box" come into the right place.

These mock front pieces of my method can be called front piece templates, as long as the same size drawer is being made, the same front piece template stays in place. When another size drawer is made that template is replaced with a template of a different size.

In the prior art, the making of this third style was difficult, because the noses of the stapling guns were used to hold the side pieces of the drawer in place prior to stapling. This would appear to be of no disadvantage, but it is my concept that this is a great disadvantage, because by eliminating this double use of the stapling guns themselves and by positioning the side pieces of the drawer by other means than the stapling guns, I am then able to free the stapling guns for shifting movements which I call indexing, so that they can be automatically positioned by the programming of the machine to staple in just the right places for each drawer depth and so that I can provide many guns in a row, some of which, for a drawer of shallow depth, will not be in alignment with the drawer. My concept is to have these non-aligned guns automatically non-firing which is a great safety feature.

Another advantage of this freedom of the guns to be indexed, as is possible because they are not also used to hold the sides of the drawer in place during stapling, is the further advantage that the guns can be indexed to anticipate various drawer side heights, speaking of a right side up drawer as it is in a desk.

Another objective of this invention is to provide for the automatic shifting of the guns of a row simultaneously as a unit after the spacing between the guns has once been pre-set in the machine by the operator. This makes it possible to have the row of guns in first positions from which firing occurs, from only the guns which are opposite the drawer, since the guns not opposite the drawer will not fire because of safety sensing provisions of the machine. This first firing might put two staples into a drawer of lesser finished height, or three staples into a drawer of greater finished height, but since further staples may be desired in the drawer, the row of guns, therefore, automatically shifts in a direction parallel to the height of the finished drawer, so that in the second position one or more guns are opposite the drawer in firing staples in accordance with the finished height of the drawer. This all occurs without any separate manual steps by the operator in readjusting stapler gun positions as in the prior art because the whole row is automatically indexed to shift a pre-set amount. Even this amount of index shifting can be adjusted in dimension, for example, from one to two inches.

Another objective of this invention is to provide for the positioning of vertically shiftable gun supporting carriages by means not only of a single air pressure used to cause them to be supported at a certain level against the effect of gravity, but also to provide an extra air pressure source opposed to the first source to press the carriages downwardly. In the use of this extra pressure source, which is a new concept in jig stapling machines, to my knowledge, the upwardly pushing effect is accomplished by an air pressure that slightly more than compensates for the weight of the gun supporting carriage whereby a much lesser opposing pressure is used to hold the carriages downwardly into a precise position not not as precisely obtainable with a supporting pressure alone, using only gravity for the downward push.

In a sense, this increases the effect of atmospheric pressure on the top of the cylinder by replacing it with an additional pressure, which herein is called the opposing pressure. This opposed pressure system has two major advantages. The first major advantage is the precise positioning of the gun carriages that is afforded.

The second major advantage is that as the carriages move downward, they move under the influence of a very, very little pressure, so that if an operator's fingers were caught between parts where they might be smashed, it will be found that the amount of pressure being applied by the combination of the second opposing air pressure and gravity against the first and carriage opposing air pressure is so little as not to injure the operator's finger at all, whereby the net pressure on the operator's fingers might be two pounds or five pounds, but not an injuring amount.

In the control of horizontal motion of heavy machine parts so as to position a left carriage of the machine closer or farther from a right carriage, I cause the pressure that moves the left carriage toward the right carriage to remain constant so as to hold drawer pieces in place, remaining constant, that is, after a control button is released. But when the left carriage is to be moved away from the right carriage, then the pneumatic mechanism provides for the left carriage to continue to move away from the right carriage so long as the control button remains depressed. Also whenever the control button is released during movement of the left carriage out from the right carriage, then such release of the control button releases all pneumatic pressures effecting the left carriage so that it simply stops, which is a convenient feature because the left carriage can be jogged out from the right carriage to the amount desired. It is also a safety feature because it will not continue to move out away from the right carriage after the button is released because the latter could accidently pinch an operator's arm between the left carriage and frame.

A third advantage is that because the left carriage need not be moved all the way out to the end and then back in toward the right carriage in order to adjust its positioning, so if the new drawer size is only slightly larger than the drawer previously programmed, the left carriage can be moved only slightly outward and only slightly back inward, thus saving valuable time.

The automatic opening timing feature of the pneumatic circuit is such that after a drawer is finished the drawer positioning parts automatically retract and the left carriage itself automatically moves a short distance from the right carriage, the latter being a pre-set and an adjustable distance.

SUMMARY

A building machine, useful for building drawers, comprising first and second carriages mounted on a frame in a manner for relative movement with respect to each other so as to be closer or farther from each other, said relative movement being along a first axis, primary and secondary, sub-carriages moveably mounted respectively on the first and second carriages and moveable in parallelism with a second axis at a right angle to the first axis, there being a work-piece space between the carriages during building, stapling guns, first and second sets of shiftable gun holders carrying the guns and disposed on first and second sides of the work-piece space, there being a third axis disposed at a right angle to the first axis and also at a right angle to the second axis, the gun holders each being spaced apart with respect to other gun holders of the same set substantially along lines parallel to the third axis, the gun holders being moveably mounted on the carriages for movement in directions parallel to the third axis whereby three dimensional adjustment of the position of each gun is possible.

BRIEF DESCRIPTION OF THE DRAWINGS

FIG. 4 is diagrammatical and all parts in FIG. 4 have their mirror image on the right side of the machine.

FIG. 4A shows the drawer front-side engager of FIG. 4 and associated parts as they would be seen in top plan view.

DESCRIPTION OF THE PREFERRED EMBODIMENT

Figure 1:
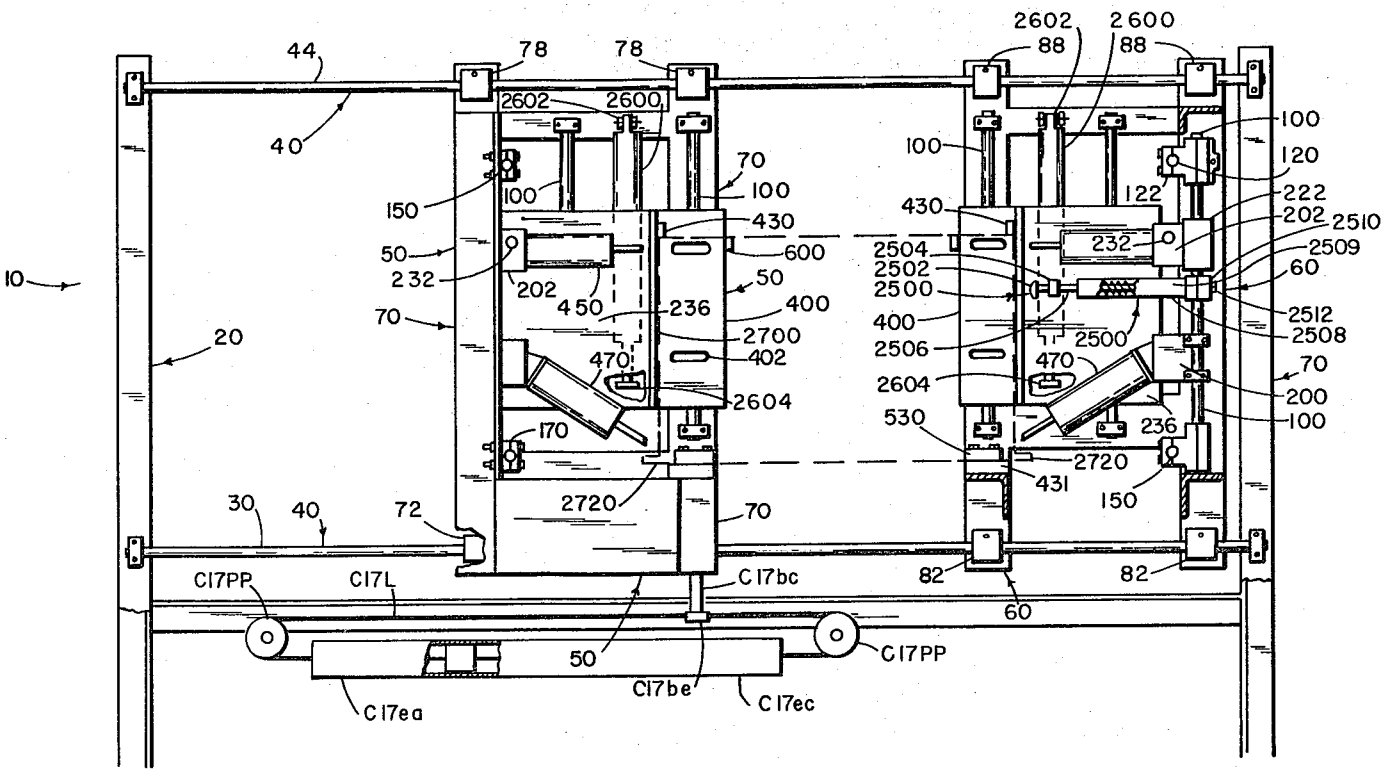
FIG. 1 is a frontal elevation of the building machine of this invention showing a drawer therein diagrammatically and in dotted lines and in a position it would be in at a time when the drawer has been completely assembled, the parts of the machine likewise being in positions that it would assume at such a time. Portions of subassembly plates at the left and right are broken away to show vertical movement controlling balancing cylinder lower portions therebehind. A portion of a sensor assembly cylinder is broken away to show its interior, a cable cylinder is also broken away to show its interior.

The drawer builder of this invention is generally indicated at 10 in FIG. 1, and comprises a frame 20, to which a pair of horizontally extending shafts 30 are affixed, the shafts 30 being disposed one behind the other. The shafts 30 being on the same level and, therefore, are called bottom shafts 30.

The machine has a carrier track assembly, generally indicated at 40, of which the shafts 30 form a lower part and an upper shaft shaft 44 forms an upper track part, the shaft 44 being disposed on the rearward side of the frame and above the shafts 30.

On the track assembly 40 a moving left carriage 50 is mounted, and the carriage 50 with all of its parts is substantially a mirror image of a fixed right carriage 60. The carriages each have a frame 70, which is mounted on the lower shafts 30 by four lower mountings 72, which slidably receive the shafts 30, two at the back and two at the front, respectively, and two upper mountings 78 which receive the upper shaft 44 and slide thereon, whereby the left carriage 50 is free to slide, although the right carriage 70 is fixed with respect to both the frame 20 and shaft or track assembly 40.

It is preferred that frame 70 of the right carriage 60 be mounted on suitable mountings 82 disposed two on the front shaft and two on the back shaft of the shafts 30 in order to make good alignment of the fixed carriage 60 and its parts with the moving carriage 50 and its mounted parts.

Also for good alignment the fixed carriage 60 has mountings 88 at its upper side, receiving the upper shaft 44 but locked with respect thereto so as not to be free to slide thereon.

On the frames 70 of each carriage are mounted two vertical shafts 100 disposed forwardly and rearwardly of each other, respectively.

Figure 3:
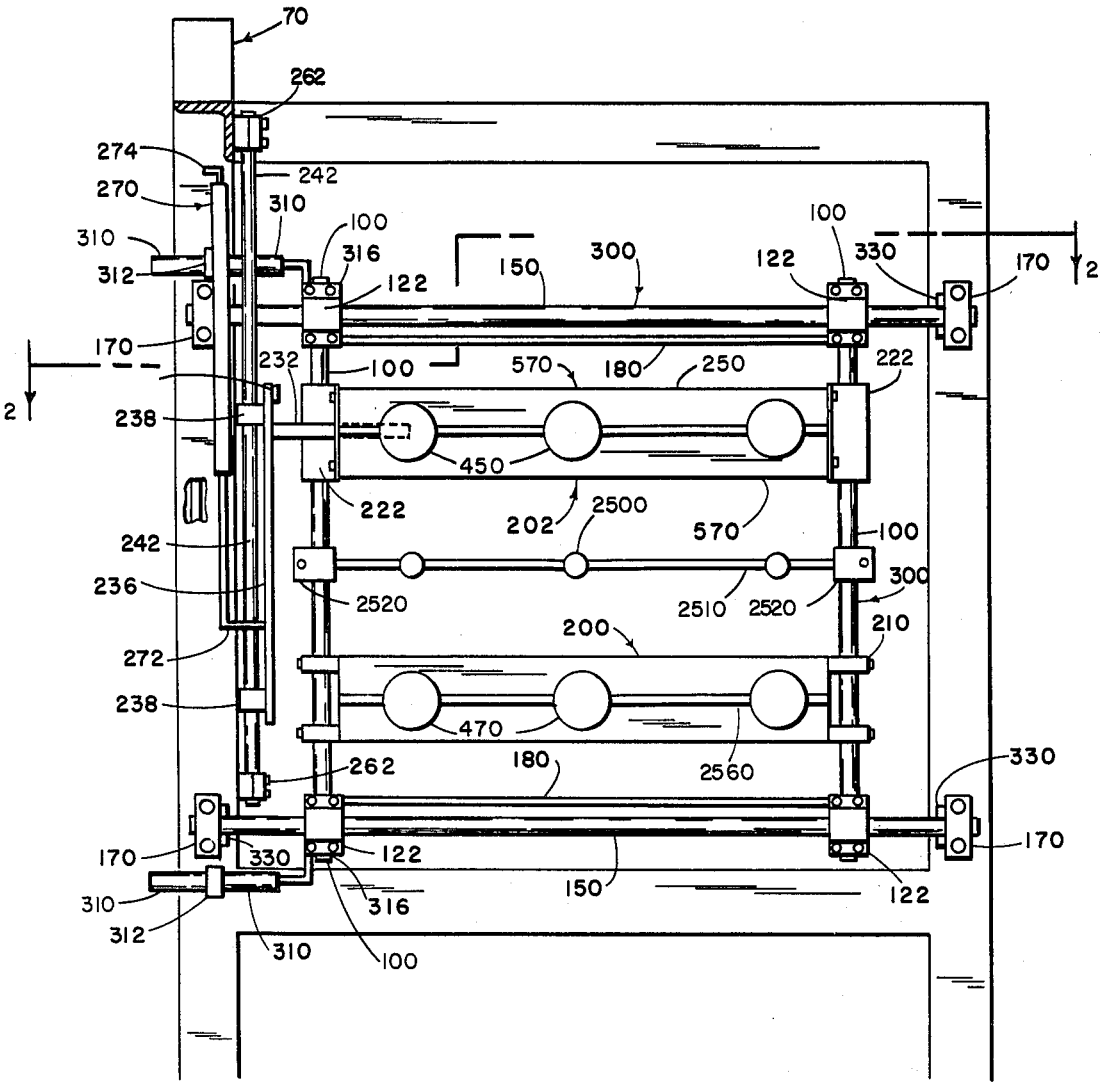
FIG. 3 is a sectional view taken along the line 3—3 of FIG. 2.

The vertical shafts 100 of the carriages are two per carriage in number with the vertical shafts of the single carriage being disposed one directly behind another and, therefore, best seen in the end view FIG. 3. Since the carriages 50 and 60 are mirror images of each other, the shafts 100 at the right of the fixed carriage 60 are disposed behind the shafts 100 of the moving or left carriage 50, as seen in left end view of FIG. 3.

The shafts 100 can be called holder shafts 100 and there are two of them for each of the carriages 50 and 60.

The holder shafts 100 are each clamped into clamps 120 at their top and bottom ends and the clamps 120 are themselves each fastened to a horizontal floating assembly bearing 122 and the bearings 122 freely slide horizontally on horizontal floating assembly mounting shafts 150, which latter are disposed one at the top and one at the bottom of each carriage 50 and 60, the shafts 150 being fixed to the respective carriage frames 70 by mounting blocks 170.

Upper and lower tie bars 180 interconnect the forward and rearward bearings 122 at the top and bottom of each carriage 50 and 60, respectively, but there are other means later explained which have substantially the same effect as the tie bars 180.

On each carriage 50 or 60 is a lower holder 200 and an upper holder 202. The lower holder 200 is vertically non-cycling, and during operation does not shift upwardly or downwardly on the holder shafts 100, although the lower holder 200 can be manually adjusted at times when the machine is not vertically operating on the holder shafts 100 in different positions by adjustment of set screws 210.

An upper gun holder 202 is vertically cycling during operation and and slides upwardly and downwardly on the holder shafts 100, since it is fixed to bearings 222, which slidably receive the holder shafts 100 respectively at the forward and rearward ends of the upper holder 202.

The position of the upper holder 202 vertically on the shafts 100 is determined by the vertical position of a horizontal stub shaft 232, which is fixed to a back adjustment member or back adjustment plate 236, which extends across the back of the respective carriage in a vertical plane, each plate 236 having bearings 238 at its upper and lower ends, two on its left side and two on its right side, receiving adjustment assembly shafts 242, respectively, which latter are fixed to the carriage frames 70, respectively, by shaft holding blocks 262.

The adjustment assembly member or plate 236 is cycled upwardly or downwardly on its shaft 242 by a pneumatic air cylinder assembly 270, having one end fixed at 272 to the back side of the lower end of the adjustment member or plate 236 and having its upper end fixed at 274 to the frame 70 of the respective carriage.

The pneumatic cylinder assembly 270 can be called an upper holder vertical positioning pneumatic cylinder 270 for later reference.

The forward and rearward positioning of the floating assembly 300 is done by means of forwardly and rearwardly extending pneumatic forward and rearward X-axis movement pneumatic cylinders 310, seen in FIG. 3. But first the floating assembly 300 is defined as including the holder shafts 100 of a carriage, the lower and upper holders 200 and 202 of that carrige, the bearings 122 which mount the holder shafts 100 on the horizontal shafts 150 and all parts that are mounted on the holders 200 and 202 such as later described, stapling guns, size censors, and drawer side holders.

The floating assembly X-axis forward and rearward control pneumatic cylinder assemblies 310 are fixed at their rearward ends by suitable means 312 to the respective carriage frame 70 and at their forward ends to respective blocks 316 which are disposed connected to the respective bearings 122 at the rear of each of the carriages 50 and 60, respectively.

Forward movement of the floating assembly 300 is limited by rubber snubbers 30 which are seen one on each shaft 150 between the mounting block 170 at the forward end thereof and inner portions of the respective shaft 150 so that the bearings 122 at their forward end strike the rubber snubbers 330 to limit forward movement of the floating assembly.

Each snubber 330 can itself be adjustable along the length of the shaft 150 for its manual positioning before cycling begins.

The snubbers 330 make it practical to use the pneumatic cylinder assemblies 310 which receive a limited amount of air pressure sufficient to carry the floating assembly forward, pushing it up against the snubbers 330 in whatever position they are set.

Referring to FIG. 1, a pair of drawer bottom engaging members are shown at 400, each being adjustably bolted by bolts to the inner edge of the respective plate 236 of the respective carrier.

The drawer bottom engagers 400 can be manually adjustable during non-cycling to the left or right because the bolts 401 fixed to the plates 236 are received in slots 406 of the bottom engagers 400.

The bottom engagers 400 are so called because they engage the bottom side of the drawer as the term "bottom side" is used normally with the drawer disposed in a desk, even though the bottom side of the drawer is facing rearward in the machine, as the drawer is built. It is to be understood, however, that the drawer bottom can be toward the forward side of the machine as another option. The machine will work both ways.

Along the right edge of the right bottom engager 400 is a drawer side engager 402, which is fixed to the right bottom engager 400 and projects forwardly therefrom a short distance.

The left drawer-side edge-engager 400 has a vertically moving drawer side back edge engager 430 fixed to its left edge and extending slightly forwardly therefrom. The right and left engagers 430 provide horizontal surfaces for engaging and positioning the sides of a drawer.

Figure 4A:
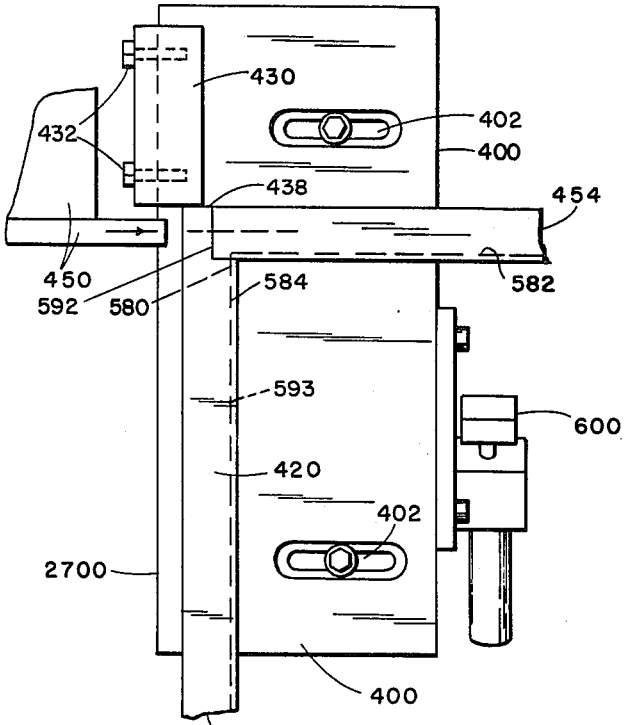
FIG. 4A is a view of the forward side engager.
Figure 4A:
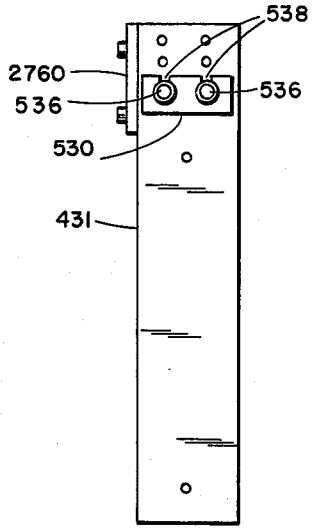
Figure 4:
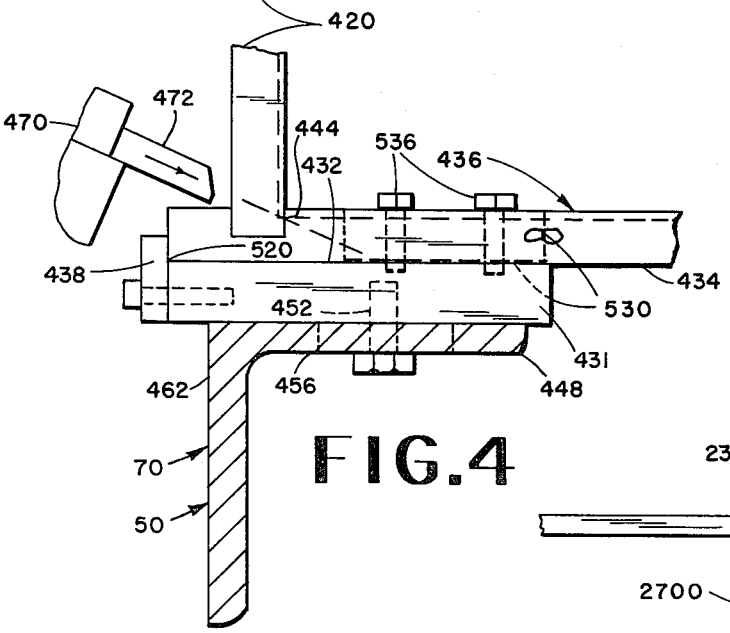
FIG. 4 is a detail showing the left-hand parts of a drawer in the process of being built and shown in a stage before the fastening of the sides to the front and rear ends, all as seen from the forward side as in FIG. 1.

In FIG. 4 a diagrammatical front view is shown of a portion of a left drawer-side edge engager 400 disposed in engagement with the back-edge of the drawer side 420, which latter is firmly held in position by a drawer-side back-edge engager 430, which latter is fixed by adjustment bolts 432 to the upper left portion of the left drawer-side edge-engager 400. In a later described cycling the entire floating assembly 300 moves downward and with it moves the drawer-side back-engager 430 so that it is able to engage the drawer-side back 438 for formly holding the drawer 420 in position.

The bolts 432 allow the vertical positioning of the engager 430 with respect to the bottom-engager 400 so as to thereby position a stapling gun 450 so that its staple outlet is directly opposite the middle of a drawer back 454, which latter is on the upper side of the drawer during building of the drawer.

All parts shown in FIG. 4 have their mirror image on the right side of the machine.

The gun 450 is one of three left side upper guns 450 which are disposed opposite three identical right side upper guns 450 so that the guns shoot facing each other, the right side upper guns 450 being disposed one behind the other in spaced relationship from the forward to the rearward along the machine and the same is true of the right side guns 450.

In FIGS. 1 and 4 a drawer front front-side engager 431 is shown, having an engaging surface 432 for engaging and positioning the front surface 434 of the front side piece 436 of the drawer and for vertically supporting same against gravity. The front surface engager 430 has a drawer front left edge engager 438 fixed to it by bolts 440 so that at a time when the left carriage 50 is caused to move very slowly to the right the drawer front 436 can be caused to rest on the top of the front surface engager 430 and continued movement will bring the drawer front side engager 438 into pressure against the drawer front piece 436 under light pneumatic pressure as later described.

The drawer front shown in FIG. 4 has a cut 444 in its rearward side, facing upwardly during the building and for receiving the drawer side piece 420 as is the case for drawers of the kind which have their fronts 436 lapping beyond their sides 420. However, because drawers sometimes have their fronts not lapping at all beyond the sides of the side pieces 420 the position of the drawer front side edge engager 431 must be manually set before cycling and this is done by the adjustment of a bolt 448, which is threaded into the drawer forward side engager 431, as seen at 452, the bolt 448 being received in an adjustment slot 456 which extends a distance right and left in the bottom frame member 462 of the frame 70 of the left carriage 50. All parts on the right side being mirror images thereof.

A set of three lower left stapling guns 470 are mounted on the lower holder 200 in a row spaced apart with respect to each other forward and rearwardly with their outlets 472 in position as the left carriage 50 reaches its limit of movement to the right for the firing of a staple from the proper position adjacent the corner made by the outside of the side 420 of the drawer and the back side of the drawer front, as best seen in FIG. 4.

Other lower guns for shooting staples are shown at 470 in a row of three in a mirror image on a right side of the machine as mounted on the right carriage 60.

Figure 5:
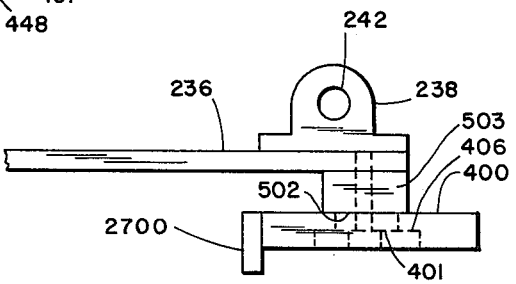
FIG. 5 shows a back adjustment plate which extends across the back of the respective carriage in a vertical plane, the plate being seen in FIG. 5 in top plan view in detail and an upper bearing being shown for receiving an adjustment assembly shaft, the view also showing a bottom engager.

In FIG. 5, which is a top view of the left carriage, the back member of plate 236 is partially shown with its bearing 238 attached, the bearing 238 being the one which is at the right side of the left carriage 50.

FIG. 5 shows that the drawer bottom engager 400 has its slots 406, but also, that the slots are disposed inwardly from a recess 502 at each slot. The bottom engager 400 is secured by the bolts 401 to the plate 236 with the spacer 503 therebetween in each case.

GENERAL OPERATING SEQUENCE

Figure 6:
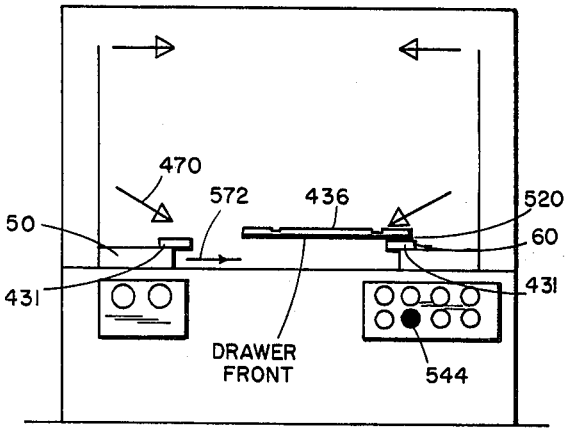
FIG. 6 is a diagrammatic view showing the position of certain parts of the machine as it begins operation.

Referring to FIG. 6, the machine begins operation with its left and right carriages at maximum spacing, as seen in FIG. 6, or at least an open enough spacing to receive whatever size drawers involved. So, in FIG. 6, the first step is to place the drawer front 436 face down into the right pocket formed by the right front support member 431 and the right drawer front end-engaging member 438, the right pocket being given a number 520 to correspond with the left pocket 520 seen in FIG. 4 formed by the corner between the drawer front support 431 and the drawer front end-engager 438.

In FIG. 6, end engagers 438 are not shown for simplicity, but the right and left drawer front supports 431 are both shown.

After the drawer front is placed in the position shown in FIG. 6, which is against the back-stop 530, which latter is only visible in FIG. 1. The back-stop 530 is disposed on the top of and bolted to the drawer front support 431. There are two back-stops 430, one on the left carriage, and one on the right carriage and two drawer front supports 431, one on the left and one on the right.

The back-stop 530, as seen in FIG. 4A, which is a top plan view thereof, is bolted to the drawer front support 530 and extends vertically therethrough so that the back-stops 430 are each manually adjustable between cyclings to different positions on the support 431 by being received in various sets of holes 542.

Referring again to FIG. 6, with the drawer front in the position shown at 436, the operator then presses the "close left carriage" button 544 which causes the left carriage 50 to move to the right so that the left end of the drawer front is received in the pocket 520 of FIG. 4 above the left drawer front support 431, whereby the drawer front is clamped into position; and the final position of the left carriage 50, as result of engagement with the drawer front 436, will determine the position of the staple gun spacing because the over-hang of the drawer front to the left of the side of the finished picture will have been measured ahead of time by the operator and the guns 470 will have their forward ends in the position shown at the left in FIG. 6, which is the position shown in FIG. 4 at 470.

Hence the left and right horizontal plane, "X-axis" position of the guns is set, since the right guns 470 will already have been pre-set in fixed position for this kind of a drawer, with this particular over-hang of its front, manually, and before cycling.

Figure 7:
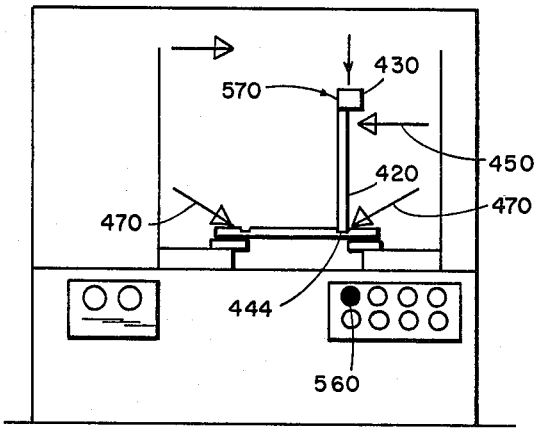
FIG. 7 is a diagrammatic view in which the left carriage has been moved closer so as to support the drawer front and thereafter a right side of the drawer has been put in place against the drawer front, the drawer front being at the bottom and horizontal, a right upper head assembly having been put in place holding the right side member of the drawer vertical.

In FIG. 7, the next step is to place the right drawer side 420 in a position with its forward end disposed in the notch 444 in the back of the front piece 436 of the drawer. Then, the operator, having put the drawer side 420 in place in FIG. 7 with his left hand, holds it there as he presses the lower upper right head assembly button 560 with his right hand, thereby clamping the right side in place, the right upper head assembly being generally indicated in FIG. 3 at 570. The lower upper right head assembly is the upper holder 202 and the back plate 236 which carries it down. The left drawer side back engager 430 is shown in FIG. 7 as mounted on the upper right head assembly 570 in engaging position with the right drawer side back end (which is now upwardly disposed).

It is a movement of the left carriage 50 to the right in the direction of the arrow 572 in FIG. 6 which is defined in the pressing of the button 544 in FIG. 6 and it is a downward movement which lowers the right upper head assembly 570, which is accomplished by the pressing of the button 560 in FIG. 7.

This clamps the right side of the drawer and positions the right upper staple guns 450.

Figure 8:
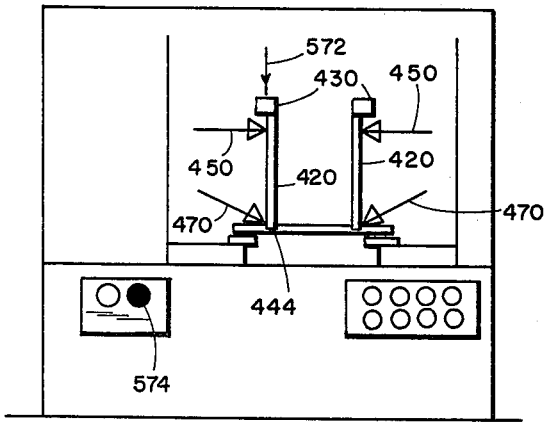
FIG. 8 is a diagrammatic view of the step following FIG. 7 in which the left side of the drawer has been put in place against the drawer front and is held vertical by a left drawer side back engager which is moved downwardly to hold it.

In FIG. 8, we see that the next step is to place the left drawer side 420 in a left drawer front notch 444 extending vertically so as to rest against the left drawer side engager 402, seen in FIG. 4, but not seen in FIG. 8. This causes the left upper head assembly 570, seen in FIG. 3, to lower in the direction of the arrow 572 of FIG. 8 until the left drawer side back engager 430 engages the left drawer side back, clamping the left drawer side and, at the same time, positioning the left upper staple guns 450, the button pressed to accomplish this was the lower left head assembly button 574 of FIG. 8.

Figure 9:
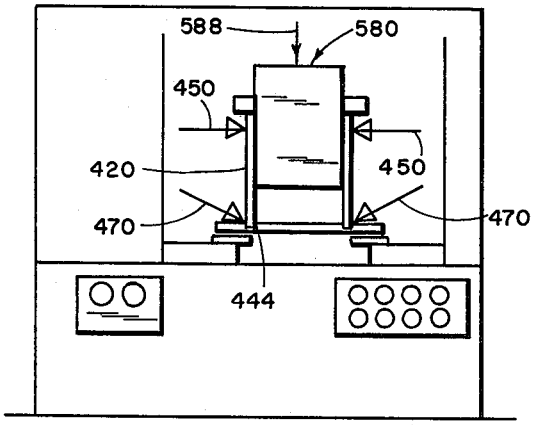
FIG. 9 is the next step showing the drawer bottom being put in place into grooves in the sides and drawer front.

In FIG. 9, the drawer bottom 580 is shown being slid downwardly into place. The final position of the drawer bottom 580 is with its upper corner, such as shown in the upper left in FIG. 9, in the position shown at 580 in FIG. 4, so as to be received in both a dado-cut groove 582 in the drawer back 454 and dado-cut groove 584, seen in FIG. 4, in the drawer side piece 420.

But, in FIG. 9, the drawer bottom 580 is in the process of moving downwardly in the direction of the arrow 588 and it is free to do so, since it is not blocked by the drawer side back engagers 430.

This whole time, the drawer side pieces 420 have been supported on their outer sides by the drawer side engagers 402 on left and right, although these are not shown in FIGS. 6 to 12.

Figure 10:
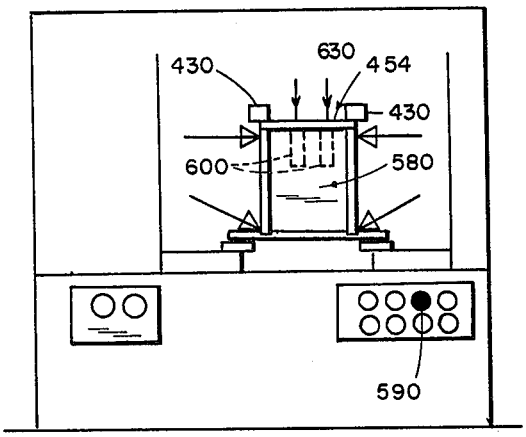
FIG. 10 is a diagrammatic view showing the next step in sequence from FIG. 9 and in which the drawer bottom engagers of FIG. 9A are in place against the drawer bottom, but are shown in dotted lines. Arrows at the top show the direction of downward movement of the drawer back side piece which has been put in place. Other arrows showing staplers the noses of which are holding the drawer sides inwardly from the right and left against the drawer bottom to hold these parts in place while the drawer back is being lowered into position.

FIG. 10 illustrates control of system only needed for a certain type of drawer and not heretofore described. Referring to FIG. 4, in which we have illustrated a type of drawer in which the drawer sides 420 are provided with a notch 592 for receiving the respective ends of the drawer back 454, whereby when the drawer back 454 is put in place, such as in FIG. 10, then it is supported by the side pieces 420 at the notch 592, as seen in FIG. 4—assuming that the drawers are of the type that has notches 592.

But, when the drawer is of a type that does not have the notches 592, then some other means must be used to support the drawer backs 454 because in such drawers, the drawer back is disposed completely between the innermost sides 593 of the drawer.

Figure 9A:
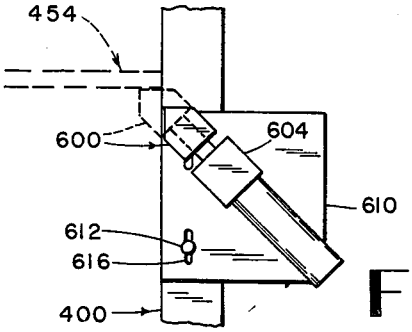
FIG. 9A is a detail showing a drawer back support shown in dotted lines in an upper position for supporting a drawer back which latter is also in dotted lines, and a few broken away associated parts.

Referring to FIG. 9A, a drawer back support 600 is shown in dotted lines in a upper position for supporting the drawer back 454 in an alternate position, the drawer back support 600 being shown in full lines in a withdrawn initial position prior to its being elevated by a pneumatic cylinder 604 attached to a cylinder support 610, which latter is adjustably attached by bolts 612 extending through slots 616, best seen in FIG. 9A, to the edge of the drawer side wall bottom engager 400, whereby the cylinder attachment plate 610 is seen edgewise in the front view of FIG. 4 with its drawer back support 600 in a lwer position of non-use.

So the cylinder 604 is predominately behind the drawer side bottom engager 400 when the machine is viewed from the front side, and it is to be understood that the reason that works is because the bottom 580 of the drawer is received in the grooves 582 and 593, which latter are disposed nearest those parts of the drawer which are closest to the viewer, looking at the front of the machine, since the finished drawer will be disposed in the machine with its bottom side to the operator.

So FIG. 10 is for the purpose of showing that the drawer back side supports 600 are employed for a certain type of drawer, there being two back side supports 600, as seen in FIG. 10, under a drawer back side piece 454, one of the back side supports 600 being carried by the left carriage 50 and the other drawer back support 600 being carried by the right carriage 60 together with the right mirror image of one of two of the cylinders 604.

In FIG. 10, the drawer back side supports 600 are shown in dotted lines because the drawer bottom 580 is then in place hiding them. So FIG. 10 shows the back side piece of the drawer already in place at 454, having been put in place after the drawer bottom 580 is slid fully into its final position which was possible because the drawer back piece supports 600 are first elevated by use of their pneumatic cylinders 604, seen in FIGS. 4 and 9A to be in a position for supporting the back side piece 454 of the drawer at the precise place desired.

Arrows 630 in FIG. 10 only show the direction or downward movement of the drawer back side piece 454 as it is put in place manually by the operator passing by the inner sides of the respective drawer side piece back side engagers 430.

So the sequence of operations includes the stage of FIG. 10, or it does not, depending upon the type of drawer. Then, the sequence moves on to FIG. 11 in which the operator holds his left hand on the back drawer piece 454 and presses the automatic staple starting button 632 of FIG. 11 with his right hand. This starts the automatic stapling by all lower stapling guns 470 and all upper stapling guns 450. That is, all guns will fire if the drawer is deep drawer, deep enough for all guns to be needed. However, it is important if the drawer is a shallow drawer so that only two guns are opposite the drawer, that a safety provision be made to keep the third gun, which has no wood in which to fire its staple, from firing its staple anyway and shooting it across the room and hitting someone in the leg. But, my provision for such safety will be described later.

So in FIG. 11 the pressing of the automatic staple cycle button causes triggering air to travel to the staple guns, but the triggering air to the staple guns cannot reach the guns for triggering the firing except unless the air is able to pass through a safety probe valve for each valve as will be later described. Also, later described is the shifting of the guns from forward positions on the machine to rearward positions on the machine, so that each gun fires from two different positions, having the net effect on a deep drawer, deep enough for the firing of all three guns in a row, of causing all four guns in any vertical plane to fire twice for setting eight staples. The total staples then driven will be three planes full of guns, four to a plane, each firing twice to total 24 staples fired with each gun fired twice, for maximum stapling where drawers are deep.

Figure 11:
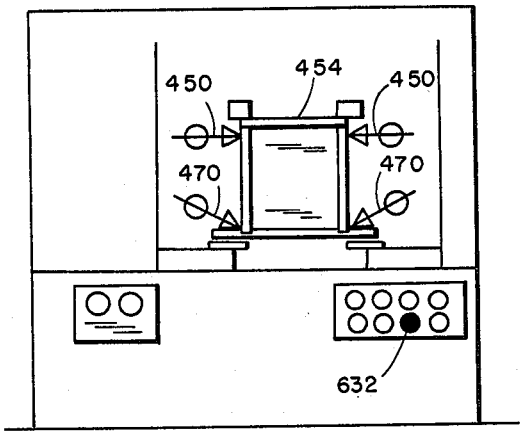
FIG. 11 shows the position of parts at the time of pressing the automatic staple cycle button.
Figure 12:
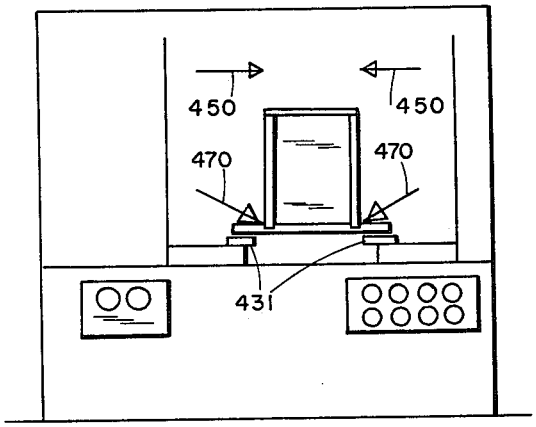
FIG. 12 is a diagrammatic view showing the position of parts after the fastening cycle position of FIG. 11 are changed by slight horizontal movement of part of the carriages, but not so much movement that the drawer is free to fall.

In FIG. 12 the position of parts is such as they are in, after fastening cycle positions of FIG. 11 are changed by slight horizontal movement apart of the carriages, so as to space all guns 450 and 470 from the drawer slightly. But such carriage movement is insufficient to allow the drawer to fall, and little enough to cause the drawer to remain supported by the drawer front supports 431.

Figure 13:
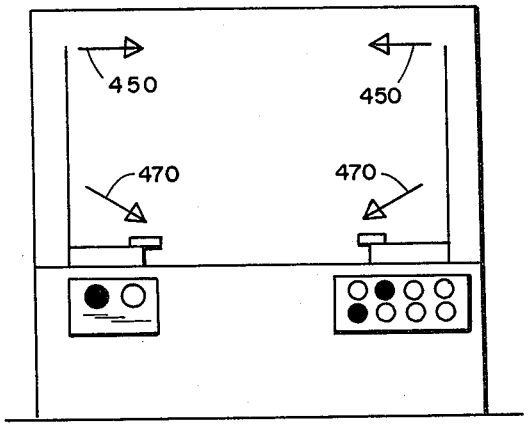
FIG. 13 shows the position of parts in which the carriages are farther spaced and in which the drawer has been removed and parts are ready to build another drawer of any desired size.

In FIG. 13 the drawer of FIG. 12 has been removed and the positions of right and left carriages are spaced still further apart so as to be ready to build a still larger drawer.

Figure 23:
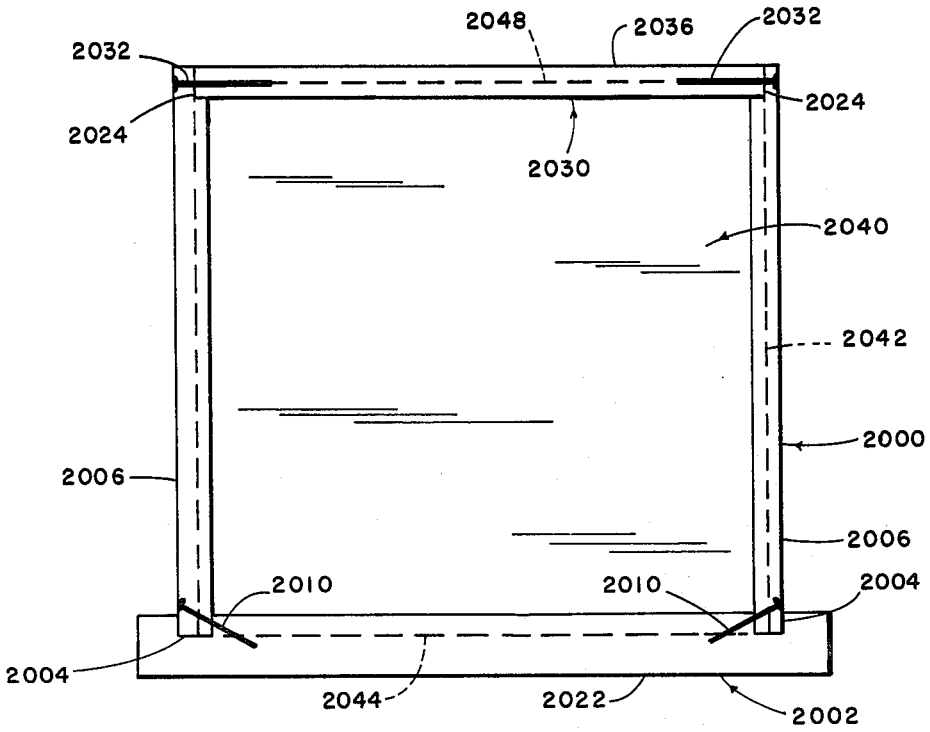
FIG. 23 is a frontal elevation of a notch sided drawer modification.

Referring to FIG. 23, a first of many styles of drawer is shown there at 2000. The drawer 2000 has a front 2002 having two recesses 2004 that receive the forward ends of the sides 2006 of the drawer being held in the notches 2004 by staples 2010 driven in diagonally at an acute angle with respect to the forward side 2002 of the drawer front entering through the sides 2006.

At the rearward side of the drawer of the first type 2000, the sides 2006 are provided with notches 2024 on the inner sides thereof and opening toward the rearward sides thereof and receiving the rearward end panel 2030 of the drawer, each end of the panel being held in place by a staple 2032 extending at a right angle to the side 2006 and horizontally parallel to the outer side 2036 of the rear panel 2030. The bottom of such a drawer is seen at 2040 and is slid in place into grooves 2042 in the sides 2006 and resting at its forward end in a groove 2044 in a forward panel 2002, the bottom panel 2040 being supported on its rearward edge by having its edge extending into a groove 2048 extending along the rearward panel 2030 adjacent what will be the finished bottom side thereof. The bottom panel 2040 is slid in place after the sides 2006 are in place and before the rear panel 2030 is put in place. Stapling occurs in sequence after the rear panel 2030 is in place. Since the drawer is of FIG. 23 and seen at 2000, is held in the machine with front panel 2002 downwardly and with the sides 2006 extending vertically, whereby it is possible for the back piece 2040 to be held in place by gravity before it is stapled in place, which leads to a possibility of an operator finding it simple to reach a position in which he must slide the bottom piece into position. During the entire building of the drawer, when it is held in the position of FIG. 23, the entire drawer is at a minimum distance from the operator's position in front of the machine for easy reaching.

As elsewhere described herein, the machine itself establishes the positions for the parts, once the front piece 2002 is pushed in proper place in the machine. For that reason, the operator can manually do his jobs simply and with perfection.

Figure 24:
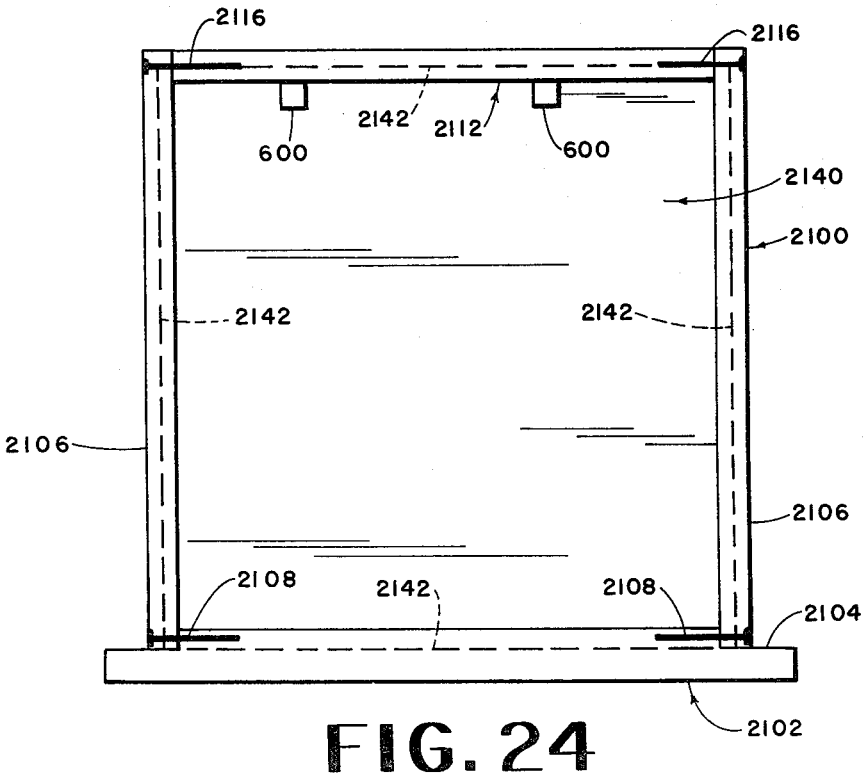
FIG. 24 is a frontal elevation of a lap-sided drawer modification.

In FIG. 24, a second style of drawer is there shown at 2100. The second drawer style 2100 likewise has its forward side panel 2102 at the lower position in the machine, and the panel 2102 has notches 2104 in its rearward side that open towards its ends and that receive the forward ends of the side panels 2106 respectively, and staples 2108 extend through the forward ends of the side panels 2106 at a right angle to the side panels and into the forward panel 2102.

The second style of drawer in FIG. 24 has a rear panel 2112 which is simply received against the flat inner sides of the rearward ends of the side panels 2106 in abutment and without any notches, and the rear panel is held in place by staples 2116 at a right angle to the sides 2106. In the second style drawer 2100, there is likewise a bottom panel 2140 which is received in grooves 2142 cut into the inner sides of the front side and back panels a short distance above what later will be the bottom of the drawer.

Figure 26:
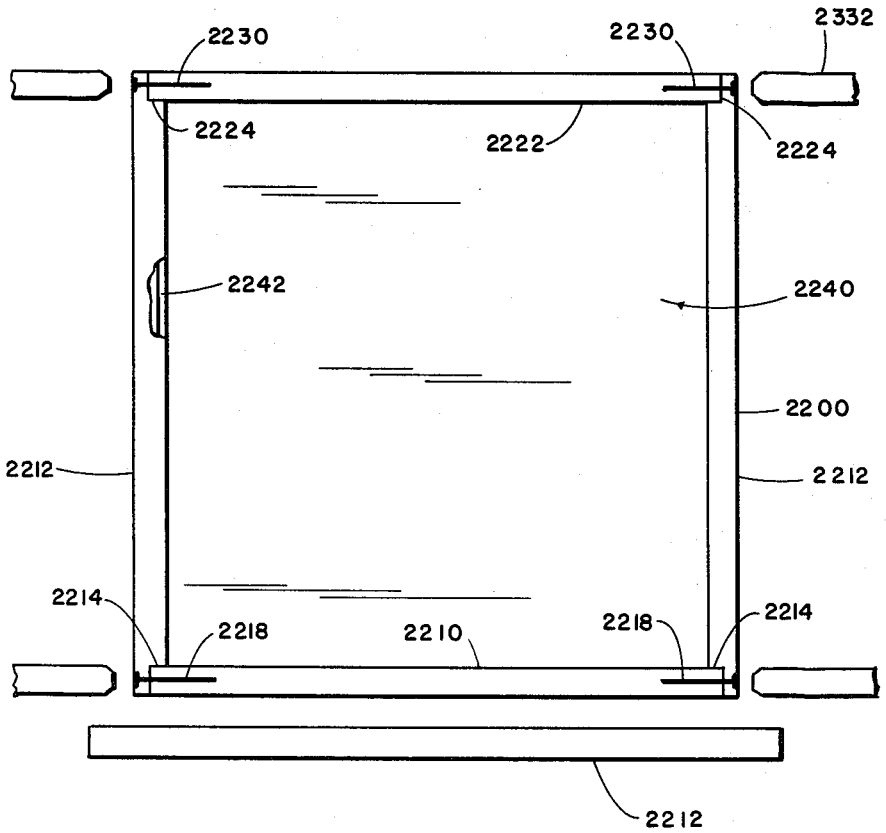
FIG. 26 is a drawer modification with sides having notched forward and rearward ends and having bottom receiving grooves.

Referring now to FIG. 26, a third type of drawer is shown at 2200 and it has a forward panel 2210 which is to be distinguished from the front finished piece 2212 which is later applied by glue after the front panel 2210 is secured to all other parts of the drawer. The mock front piece 2212 used during the making of the drawer is really only a temporary guage put in the machine for the machine to sense the later position in which the front piece of the same size will be. In that way, all parts of the remainder of the drawer come out into the right place.

For purposes of illustration in FIG. 26, however, the mock piece 2212 is shown separated downwardly a little from the remainder of the drawer, although it is actually against the remainder in the machine.

Since the same item, given the numeral 2212 in FIG. 26, is also useful to illustrate the finished false front of the drawer, yet becomes glued to the forward panel 2210, therefore, it is held separately in FIG. 26, to show that it is something that is later added.

In this thid drawer style of FIG. 26, the sides 2212 are provided with notches at their forward ends and on their inner sides and are seen at 2214, and these are positioned so as to receive the ends of the front panel 2210 so that a staple 2218 can be driven at a right angle to the side panels 2212 and parallel to the front panel 2210 through the sides and into the front, the number of staples used depending upon the height of the finished drawer.

In FIG. 26, the rear panel 2222 is received in notches 2224 at the rearward ends of the opposite sides 2212, the notches opening toward the rearward end of the sides. Staples 2230 are driven at a right angle to the sides, through the sides, and into the rear panel 2222. The drawer bottom 2240 in the drawer of FIG. 26 is put into place the same as all other drawers in a groove 2242 extending around the inner sides of forward side and rear panels, the bottom piece being put in place just before the back panel 2222 is put into place.

Figure 25:
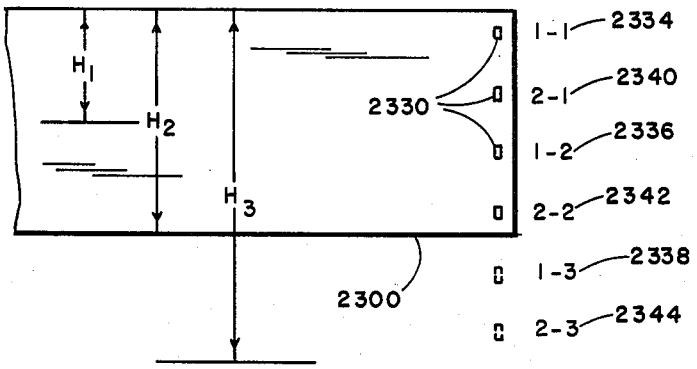
FIG. 25 is a diagram indicating the first and the second firing positions of the guns located in the same row.

Referring now to FIG. 25, the method of arrangement and shifting of stapling guns of this invention is shown by its effects. In FIG. 25, a drawer is there shown at 2300 and it is to be understood that they are on the machine in a position for placing staples in the position shown in FIG. 25, the staples being seen at 2330.

According to this invention, the staple gun 2332, seen in FIG. 26, represents a row of staple guns which can be any number of staple guns in a row to prepare the machine for various drawer heights, meaning finished drawer heights, as they would be seen in a desk. The gun 2332 in FIG. 26 would have other guns behind it in a row, and for purposes of illustration, we can pretend that there are three guns in a row in order to interpret FIG. 25.

In FIG. 25, the terminology "1-1", seen at 2334, is used to indicate the first firing position of a first gun and the terminology "1-2" at 2336 is the first firing position of a second gun in the same row.

The terminology "1-3" at 2338 indicates the first firing position of a third gun in the same row. However since the third gun would miss the drawer since its height, $H_2$, is lesser than spacing from the first to the third gun therefore, it is desirable that the third gun not fire at all, lest it fire a staple out into the air dangerously. The machine prevents this by having a sensor, later described, close to each gun position and preferably beneath the nosepiece of each gun so that if the sensor is against a drawer part then the gun will fire, but if the sensor is not touching anything the machine will automatically cause that gun not to fire.

My concept is to have the row of guns in fixed positions with respect to each other and shifting simultaneously as a row, consequently, after firing the first time then the guns shift so that the numeral "2-1" at 2340 indicates a position of the second firing of the first gun, the numeral "2-2" at 2342 indicates the position of the second firing of the second gun and the position indicated "2-3" at 2334 indicates the position of the second firing of the third gun, which latter would miss the drawer if it fired and so it can be describer as only a firing position because the sensor, not having touched the drawer, will cause the third gun not to fire in the position 2334.

If the drawer height were smaller, such as indicated at $H_1$ then the second and third guns in a row would miss the drawer on the first and second firings and on the first firing only the first gun would be opposite the drawer to fire into the position 2334, and at that same time no other guns would fire. After the first shifting, the second firing would take place and because the drawer would be of such little height as indicated by $H_1$, in the second shifting the first gun would be the only one firing and it would fire at 2340.

As can be seen in FIG. 25, the numeral $H_3$ indicates a drawer of greater width than shown and one large enough so that even on the second firing all of the three guns would still be opposite the drawer, whereby on the first firing staples would be driven at 1-1 and at 1-2 and at 1-3, and on the second firing staples would be driven at 2-1,2-2, and 2-3.

FIG. 25 illustrates the same firing sequence for the other rows of guns at each of the other three corners.

Great safety is achieved because, if the machine should become cycled without any drawer in it, then no stapler would fire because of the sensors.

Referring to FIG. 1, a sensor assembly is there generally indicated at 2500 and comprises a probe tip 2502 for engaging the drawer piece, the probe tip being movably mounted on a valve 2504 carried by the piston rod 2506 of the pneumatic cylinder assembly 2508, the assembly 2508 having a cylinder 2509 supported by mounting 2510 which is fixed to the right forward one of the shafts 100, as seen in FIG. 1. The particular position along the shaft 100 for the sensor 2500 is not critical, except that it should be some place between the guns of the upper and lower levels, such as the gun 450 and the gun 470, seen at the right in FIG. 1.

A drawer building machine having a machine frame, right and left carriages each having a frame, the frames of said carriages being mounted on said machine frame in a manner such that said carriages are movable linearly with respect to each other in a horizontal direction for defining an "X" movement.

Referring to FIG. 1, it can be seen that the connector 2508 actually extends from the right forward shaft 100 to the right rear shaft 100, the latter being seen at the left in FIG. 3, being fixed to both shafts in an adjustable position along the shafts bases, such as by release and readjustment, as done by a pinch clamp bolt 2520, seen in FIG. 3, of which there is one at the right and one at the left of FIG. 3 at each end of the mounting 2508.

On the mounting 2508 is a lengthwise slot 2510 facing inwardly of the machine and it is in this slot which extends forwardly to rearwardly in the machine that the three sensor assemblies 2500 are adjustably mounted for movement to any desired positions along the slot 2510.

A lock nut 2512, seen in FIG. 1, is disposed on the backside of the mounting 2510 so that as the lock nut 2512 is loosened, its probe assembly 2500 can be moved to any desired position along the slot 2511 and will stay in place after the lock nut 2512 is tightened up again.

A similar arrangement is available for the stapler guns 450 and 470.

Figure 2:
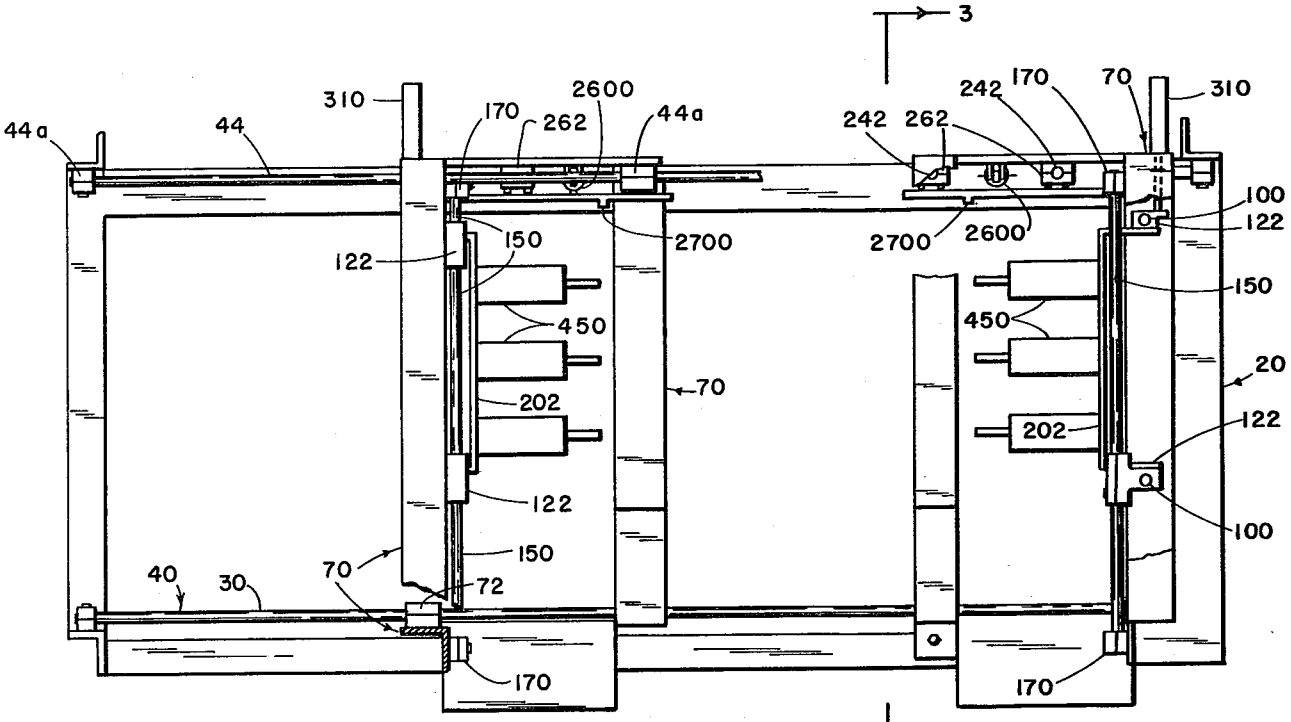
FIG. 2 is a sectional view taken along the line 2—2 of FIG. 3.

As best seen in FIG. 2, the stapler guns are mounted on upper and lower holders 202 and 200, each of which latter have horizontal slots 2560 therein which extend therethrough from left to right and extend lengthwise from the front to the rear of the respective members 200 and 202, whereby the guns also can be adjusted forwardly and rearwardly, each one individually, on the members 200 and 202. This is done by a similar method to that described as regards to the sensor. In other words, a lock nut is involved, not shown, but no need to show it is believed necessary, since the method is identical to the lock nut releasable adjustment 2512 above described.

Although the lower holder 200 is resetable manually along the shaft 100, yet it remains stationary during automatic operation. Conversely, the holder 202 moves up and down by push-button and pneumatic cylinder operation, as later described, for positioning to the size of a drawer, although it is also stationary, once completely automatic operation is begun for stapling.

A help is to remember that during automatic cycling, nothing moves except the indexing of the guns, as described above in regards to FIG. 25. Further understanding of that can be had from FIG. 25 which diagrammatically shows the guns of the machine, the total guns being twelve, six on the right and six on the left, in the example machine shown. The guns on the right are shown with the upper guns at 450 and the lower guns at 470.

Referring to FIG. 1, right and left balancing cylinder assemblies are shown at 2600 fixed between the respective frames of the right and left carriages at their upper ends, as seen at 2602, and connections at 2604 to the respective right and left adjustment plate members 236, whereby the balancing cylinders 2600 control the position of the adjustment assembly plate members 236 with respect to their carriage frames.

When the machine is at rest, which is at times when the balancing cylinders 2600 are pressurized, then the adjustment assembly plate members 236 are in a maximum upper position, not shown in FIG. 1, because of the lifting effect of air pressure in the cylinders 2600 causing them to contract thereby lifting the adjustment assembly plate members 236 and consequently lifting everything the plate members 236 are attached to, namely, the guns 450, the moving upper holder 202 and the associated parts. The lower holder 200 does not move. The probe assembly 500 in FIG. 3 and FIG. 1 do not move as the balancing cylinder 2600 raises and lowers the adjustment assemby plate members 236.

The air pressure in a later described low pressure manifold at the lower left in FIG. 15 has the effect of causing the balancing cylinder 2600 to contract on both sides of the machine, both balancing cylinders 2600, right and left, being controlled from the same low pressure manifold, shown at d6 in FIG. 15. This has the effect of supporting the weight of the parts lifted against gravity. Next, it is desired to cause the parts so lifted to be pressed downwardly until such time as the drawer side back engagers 430 of FIG. 1, also seen in FIGS. 10 and 11, contact the backside of the drawer at the right and left ends thereof. This is a sufficient pressure to hold the drawer firmly in position during stapling. The heavy parts can then be brought down very slowly by little pressure because there is no danger of a fast downward movement since the upward forcing of the heavy parts are already taken care of with the effect of gravity, so that a little pressure added on to the top part of the cylinder will force the parts downward for drawer engagement.

Figure 14:
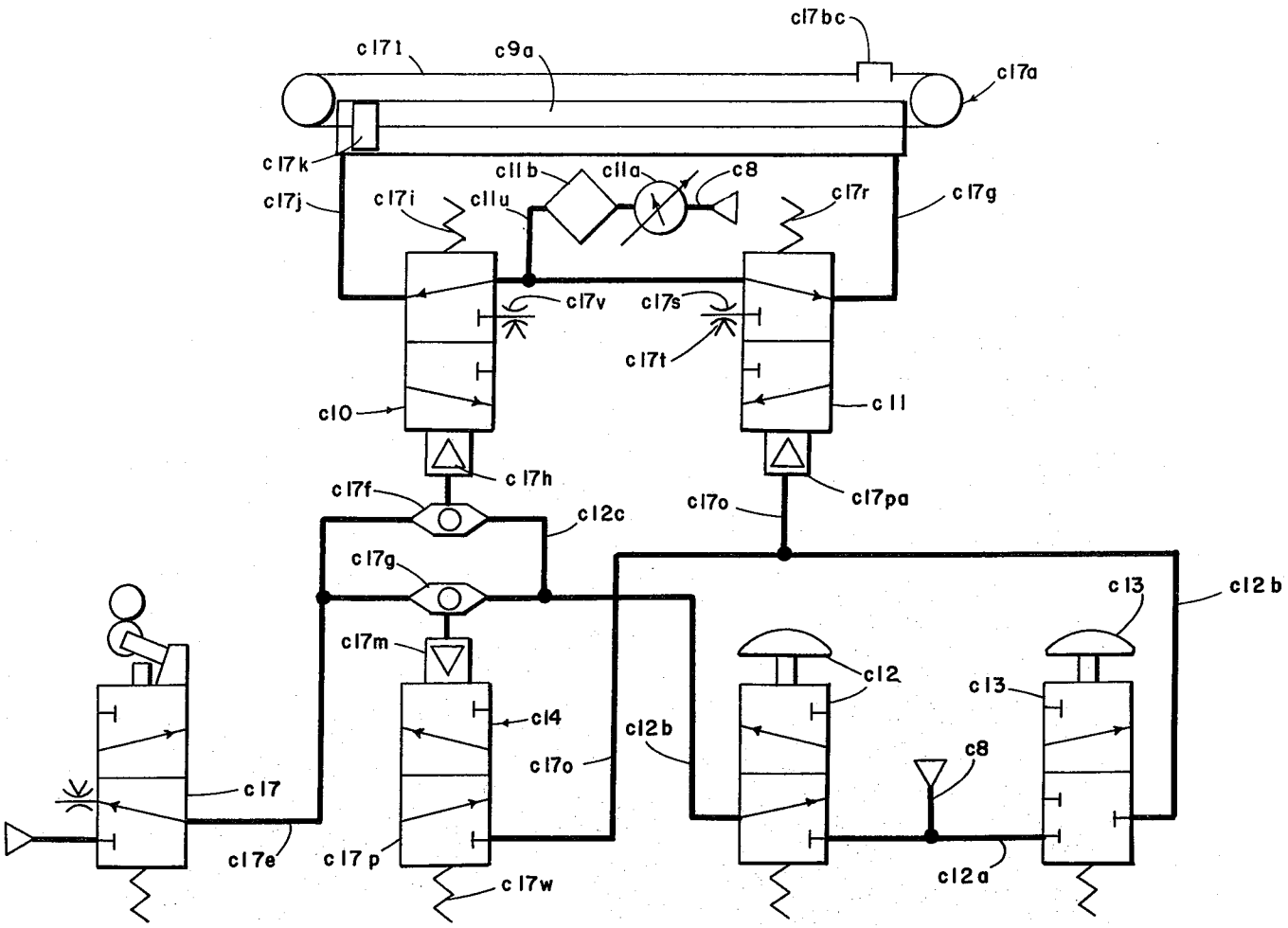
FIG. 14 shows a pneumatic diagram of the carriage movement system which causes the left carriage to move horizontally.

The pneumatic control of the movement of the left carriage toward the right carriage and back is accomplished by a cable cylinder assembly seen in FIGS. 1 and 14 at C17la of which a cylinder portion is seen at C9a in FIG. 1, end pulleys are shown at C17pp in FIG. 1 and the endless cable is shown at C17l having a padlock C17l fixed to the upper side thereof, a block connector C17bc connecting the top block to the left carriage frame 70, whereby the cable cylinder controls movement to the right and left of the left carriage 50. The cable cylinder has been described already in regards to FIG. 14.

A side guide to engage the sides of the drawer to enable easy positioning manually is best shown in FIG. 1 at 2700, there being two, one on the right carriage and one on the left for engaging the left and right sides of the drawer. This side guide 2700 is also seen in FIG. 5 which is more detailed in this regard than the FIG. 2, although the side guide is shown at 2700, also, in FIG. 2 on each side, but without special extra mounting, since it is indirectly carried by the back plate 236.

Referring to FIG. 4A, a door measuring stopping block is shown at 2720 and it can also be seen in FIG. 1.

Figure 20:
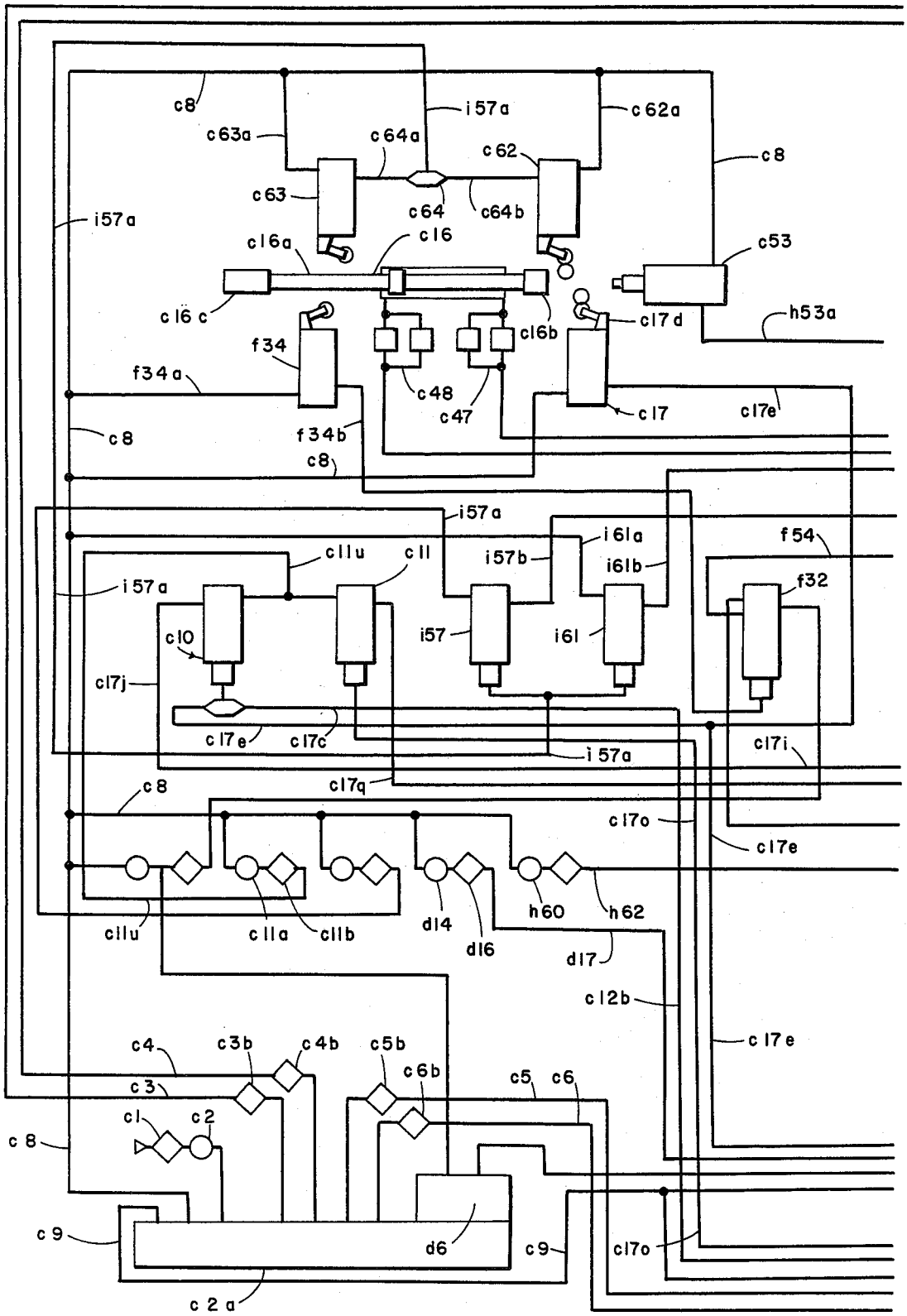
FIGS. 20, 21, and 22 are left, center, and right parts of the total pneumatic diagram of the machine hereof.
Figure 21:
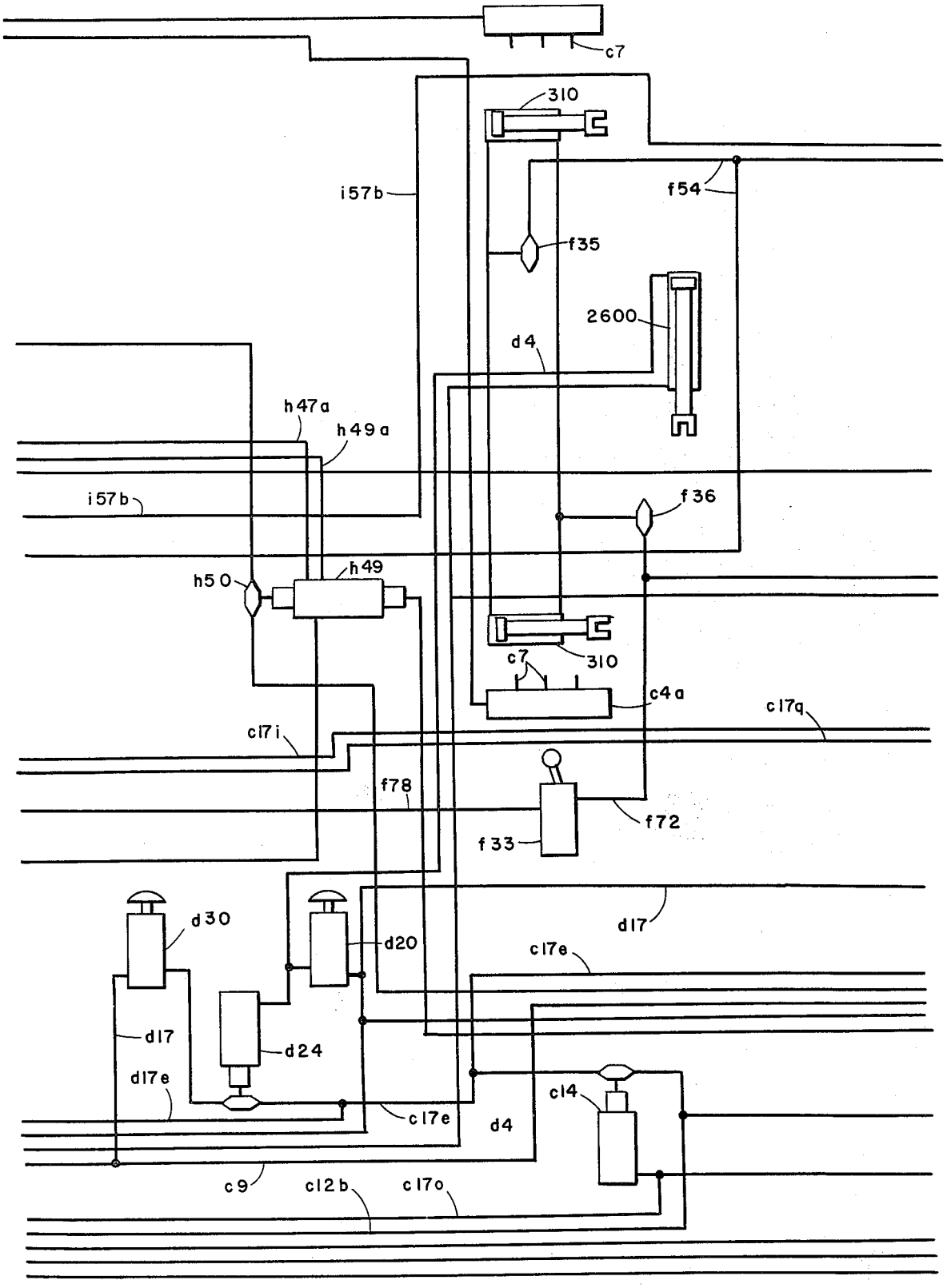
Figure 22:
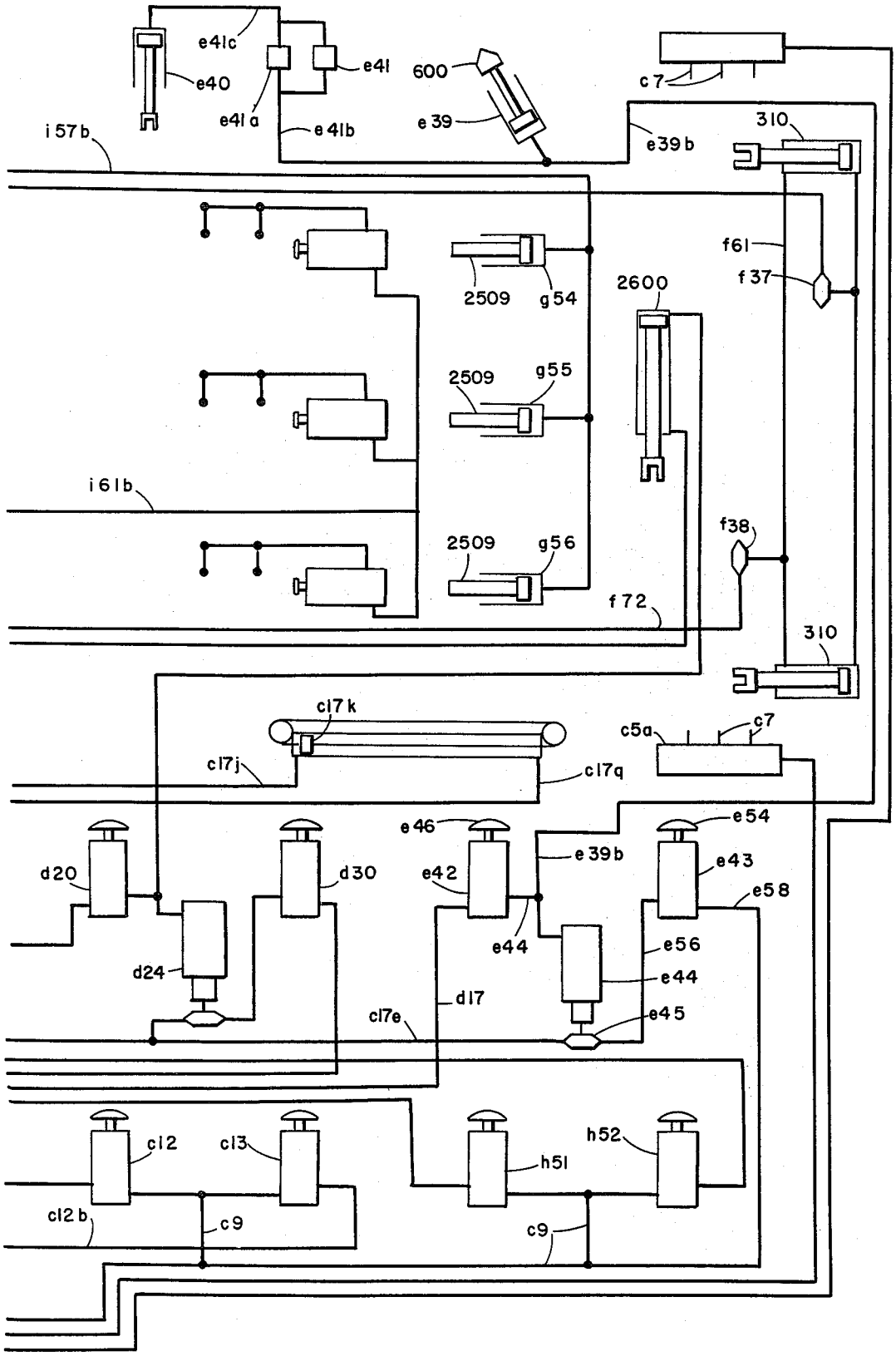

Referring to FIG. 20, the pneumatic circuitry of this invention is shown as much as can be on one drawing page, and the remainder of the circuitry is shown in FIGS. 21 and 22.

FIGS. 20, 21 and 22 are meant to be placed in sequence with FIG. 21 in between 20 and 22, from left to right, so as to represent one large, composite, pneumatic circuit.

However, as a further aid to understanding this system, reference can be made to sectional circuitry of FIGS. 4–19, inclusive.

Referring to FIG. 20, inlet air at a maximum of 150 PSI is filtered at c-1 and is regulated at c-2 to assist in pressure of between 80 and 90 PSI.

On all sectional circuitry diagrams, FIGS. 14–19, supply lines are also at 80 to 90 PSI. This system pressure air is held in the main air manifold c2a FIG. 20 located on the back of the machine. Supply lines c3, c4, c5, and c6, FIG. 20 from the main manifold c2a extends to gun manifolds c3a, c4a, c5a, and c6a, respectively, FIGS. 21 and 22, the first and last of which are located at the top of each of the carriages 50 and 60. The other two are located at the bottom of each of the carriages 50 and 60, respectively.

Air in the lines c3, c4, c5 and c6, FIG. 20, is lubricated by gun lubricators c3b, c4b, c5b, and c6b, respectively.

From the gun supply manifolds c3a, c4a, c5a, c6a, FIGS. 21 and 22, lines extend to respective stapling guns, and such lines are generally indicated at 67, seen at tops and centers of FIGS. 21 and 22.

The main manifold c2a also supplies air under pressure to the control blocks, such as through lines c8 and c9. The line c8 delivers into regulators for delivering five lower pressures for various functions of the control system. These lower pressures will be described later.

The carriage movement system will now be described with reference to FIG. 14, particularly, but also to the general circuit of FIGS. 20, 21 and 22. To provide for variation in the width of a drawer, the left side carriage is mounted on a system of linear bearings used to allow low friction movement. A cable-type air cylinder c9a is used to power the left carriage closer to, or further from, the stationary right carriage. In the rest position, both of the carriage control valves c10 and c11 are in the open position.

Air is supplied to the valves c10 and c11 through the carriage pressure regulator c11a, seen in FIG. 20, and is lubricated at c11b to provide long life.

When either of the valves c10 and c11 are actuated, the respective valve closes and exhausts its corresponding end of the cable cylinder c9a. This allows the opposing pressure to move the piston in the cylinder, thereby moving the carriage.

When the carriage "in" button c13, seen in FIG. 14, is pressed and released, a pilot signal is sent to the "in" control valve c11 and is trapped in the line, causing the control valve c11 to remain piloted. The carriage will move towards the right until it is stopped by the drawer front.

This pilot signal remains trapped in the line until the release valve c14 is piloted. When piloted, the release valve c14 exhausts the trapped signal, the "in" control valve c11 opens, and the carriage stops.

The release valve c14 may be piloted by either of two ways. The first way is by pressing the carriage "out" button valve c12. When valve c12 is pressed, it pilots both the release valve c14 and the "out" control valve c10, which closes, exhausting the out-end of the cable cylinder c9a, causing the carriage to move to the left.

There is no trapped signal in the "out" control, therefore, the carriage will move only while the "out" button at out-valve c12 is being pressed.

The other way the release valve c14 is piloted is by the release pilot valve c17, which is located on the timing plate inside the control box.

Referring now to FIG. 20, a timing cylinder is there described at c16 having a pneumatic plunger c16a having a right timing cam c16b at its right end and left timing cam c16c at its left end. The timing cylinder c16 has its timing cam head c16b in a position for striking a roller c16d of a release pilot valve c17. Because of the roller c16d being free to move to the right when struck by the cam head c16b, therefore, the release pilot valve c17 is not actuated by a rightward movement of the cam head c16b. However, with each cycle of the machine, the plunger c16a will move both out and back and so on its leftward movement, it will strike the roller c16d causing a lever c17d to be moved downwardly which causes a flow of signal from the in-pressure line c8 to out-line c17e.

The line c8 in FIG. 20 has many branches, and rather than having many numbers, as might be confusing, instead each branch of the line c8 will also be called c8 so that c8 refers to a network of supply air.

Now with the signal going out the line c17e, its route, as seen in FIGS. 14 and 20, is to a shuttle valve c17f and a second shuttle valve c17. The shuttle valve c17f has, in effect, now to be described. As long as the pressure is on the shuttle valve c17f, then the pressure pilot c17h connected to the shuttle valve c17f will be pressurized causing the valve c10 to shift against the pressure of its spring c17i to admit air through the out-line c17j to the cable cylinder c9a causing its piston c17k to move to the right which causes the uppermost cable section c17l of the cable cylinder c9a to move to the left for causing the left carriage to move to the left which opens the machine so that a finished drawer can be removed and parts of a new drawer can be put in place in the machine.

Simultaneously, as the pressure is delivered through the line c17e to the shuttle valve c17f, it also delivers air to the shuttle valve c17g which pressurizes the pilot valve c17m for causing the release valve c14 to be operated against its spring c17n so as to permit signal to be dumped from a line c17o to the atmosphere through an outport c17p.

The line c17o receives signal to be dumped from a pilot valve c17pa which receives signal from the carriage in-control valve c11, which latter receives signal from a line c17q from the right side of the cylinder of the cable cylinder assembly c9a which is necessary for dumping air out of the right side of the cylinder of the cable cylinder assembly 69a in order for air to enter the left side thereof to move the piston c17k to the right, whereby simultaneously, as the line c17j is closed, the line c17q is open. This operation is because the minute pressure is released at the pilot valve c17p, then the spring c17r of the carriage in-control valve c11 causes the valve to shift into a position for passing signal through from the line c17q out through the line c17s which dumps it to the atmosphere, permitting rightward movement of the piston 17*k*.

A control valve c17t controls the speed of outflow of the air to the atmosphere for regulating the speed of movement of piston c17k.

The way pressure passes through the line c17j to move the piston to the right is because it comes through piston pressure lines c8, as best seen in FIG. 14 to a pressure regulator c11f, earlier described, and delivers through a pressure lubricator c11b to an end line c11u leading to the carriage out-control valve c10. And air can pass in-line c11u through the out-line c11j only when the pilot valve c11h has so actuated the carriage out-control valve c10 as to permit this at times when the pressure valve c11h is pressurized.

It is to be understood that the pressure valve c11h and its equivalent on each of the control valves do not pass the larger air through them, but only pass smaller amounts of control-air through them sufficient for operating the larger control valves c10 and c11, etc., so that the latter larger valves are then opened in the right way for delivering major air flow.

An air flow control at c11v on the control valve c10 regulates the speed of the dumping of air to the atmosphere so as to control the speed of motion of the piston c17k as it moves to the left for controlling movement of the carriage 50 to the right because of the cable section c11l to which the carriage 50 is attached.

As heretofore described, the carriage 50 of the machine has moved to the left for opening the machine and now we will describe how the carriage 50 is moved again to the right for closing it during drawer building.

Referring to FIG. 14, an air supply is seen at c8 delivering air through a line c12a to the inputs of button valves c12 and c13. When the button of the button valve c13 is manually pressed, there is a flow of air from line c12a out through line c12b into the line c17o. This pressurized the pilot c17p causing shifting of the carriage in-control valve c11 against the spring c17r, whereby air is admitted into the carriage in-control valve c11 through a line c11u earlier described, and the flow out from the carriage in-control valve simultaneously flows through line c11q to press the piston c11k toward the left for moving the carriage 50 in a closing direction to the right.

As long as pressure is maintained at the pilot c17p, then the piston c17k and the carriage 50 will move until the carriage 50 has come into contact with the drawer pieces, whereup a clamping action takes place without any further movement of the carriage 50 to the right and without any further movement of the piston c17k to the left. This is how clamping pressure is maintained during stapling. And so the cycling is complete preparatory to a re-cycling in the other direction as earlier described.

An emergency manual valve is shown at c12. Its only purpose is to do the same thing manually that the release pilot valve c17 does automatically. The manual valve c12 has its in-line connected to the line c12a and its out-line connected to the line c12b which is connected itself to a line c12c leading to the shuttle valve c17f and also to the shuttle valve c17g.

The purpose of the two shuttle valves c17f and c17g connected in parallel is so that a signal coming to the valves c17f and c17g through the line c17e has exactly the same effect as a signal coming to them through the line c12b, in either case, causing the respective pilot valves c17h and c17m to be pressurized.

The way the shuttle valves c17f and c17g are constructed is so that no air can pass directly from the line c12b to the line c17e, or the reverse. It only causes motion at the shuttle valves.

Figure 15:
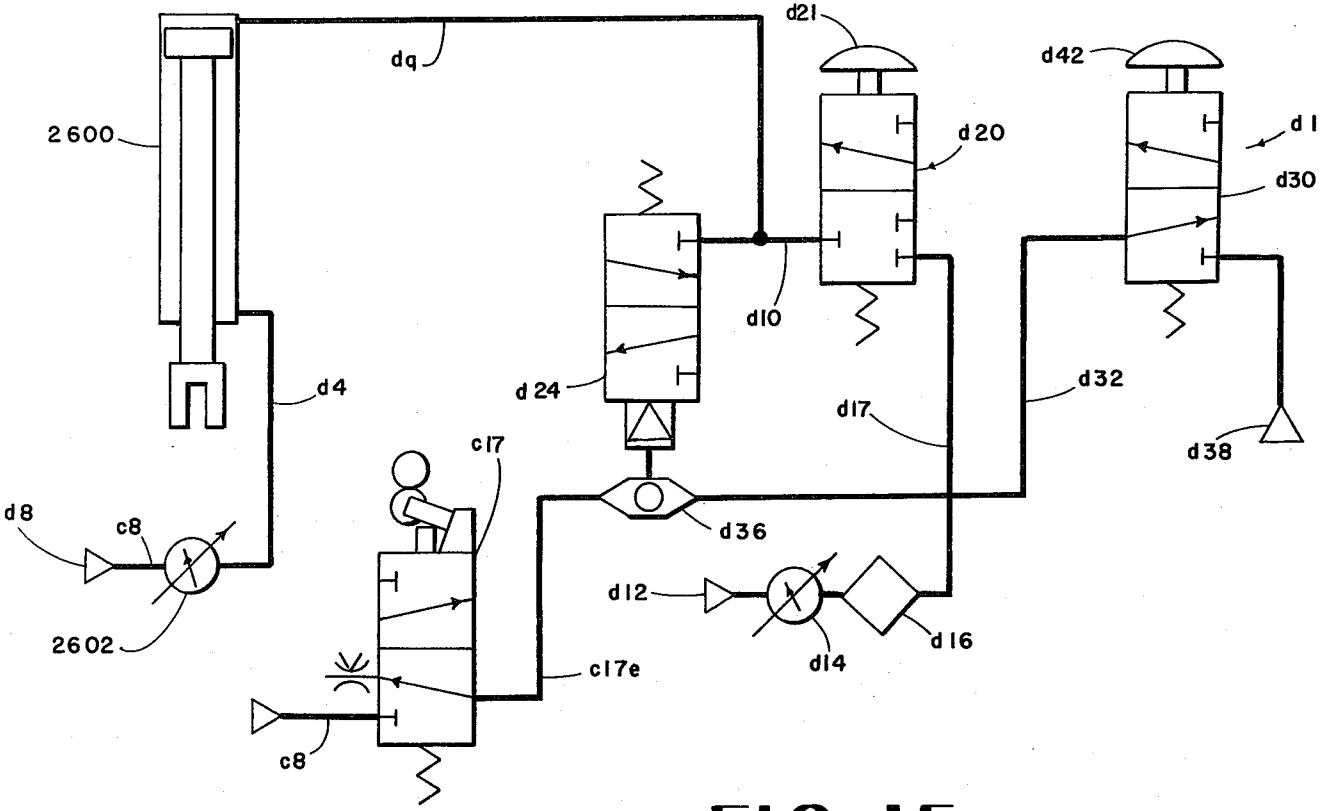
FIG. 15 is a vertical movement control circuit.

Referring to FIG. 15, the vertical movement circuit of this invention is there shown and generally indicated at d1.

The circuit shown in FIG. 15 represents two vertical movements circuits since there are two such circuits in each of the machines of this invention and this must be kept in mind particularly when comparing FIG. 15 to the composite circuit diagrams of FIGS. 20,21 and 22.

The balancing cylinder 2600 of FIG. 15 can be either one of the balancing cylinders 2600 already described in FIG. 1, and it receives its pressure through a line d4, which latter has a low pressure manifold d6 in it, the latter not being seen in FIG. 15, but being visible in FIG. 20, the low pressure manifold in the line d4 receiving its pressure from an air manifold c2a because the air manifold c2a delivers out through a line c8 which passes through a low pressure manifold regulator 2602 seen in FIGS. 15 and 20.

A triangle symbol d8 in FIG. 15 is typical of many triangle symbols throughout the circuit diagram and the triangles indicate air supply in each case, the particular air supply d8 of FIG. 15 happening to be the air manifold c2a.

The balancing cylinder 2600 is called a balancing cylinder because only enough air is passed through line d4 to the bottom side of the cylinder 2600 to lift the weight of parts earlier described. The line from the other end of the vertical movement cylinder 2600 is seen at d9.

The pressure in the lower side of the balancing cylinder 2600 as coming through the d4 is static with just enough pressure to maintain vertically moving parts in their position, as earlier described, against the force of gravity.

The line d9 in FIG. 15 leads to a line d10.

In FIG. 15 an air supply is indicated at d12 delivering air to a down pressure regulator d14 which in turn delivers to a lubricator d16 which delivers to a line d17 connected to the inside of a left two-way button valve d20 from which the outline d10 leads to the line d9. It is understood that pressure cannot come from the source d12 to the line d9 through the button valve d20 except at times when button d21 is depressed, And that, of course, is the time when downward vertical movement of the piston in the balancing cylinder 2600 is desired.

The button valve d20 also serves to hold the signal so that the air pressure in the line d9 maintains a desired clamping pressure on the balancing cylinder 2600 for desired positioning on the parts of the machine to hold the sides of the drawer in place in a clamping action.

The air that is trapped in the lines d10 and d9 remains trapped until it is released by one of two signals going to the release valve d24. A first one of such signals comes from a right button valve d30 through a line d32 and through a shuttle valve d36 connected to the release valve d24.

The right button valve d30 receives its pressure from a pressure source d38 and passes this pressure to its out line d32 only at times when its button d42 is depressed.

The buttons d21 and d42 of the button valves d20 and d30 are manually depressed on the control panel seen in FIGS. 6–13 with the particular button depression most recently described herein being shown in FIGS. 7 and 8.

The button d21 of FIG. 15 corresponds to the button 560 in FIG. 7 and also corresponds to the button 547 of FIG. 8 because the button d21 in FIG. 15 is a sample of the two buttons 560 abd 574 since FIG. 15 defines a vertical movement circuit of which there are two in the machine. Understanding is asked for on the part of the reader for the use of a difference in terminology which is believed to lead to clarity and distinguish from further confusion, the clarity being believed to be achieved by simply explaining that the button d21 in FIG. 15 is a sample of the buttons 560 and 574 in FIGS. 7 and 8.

We have finished describing the manual side of the control of the release valve d24 through the button d21. Now, we will describe the automatic control of the release valve d24 and the air pressure for that begins at the line c8 and leads to the release pilot valve c17 earlier described and which is useful for control of many things in the circuit. The release pilot valve c17 has it out line c17e which leads to a shuttle valve d36 which is connected to the release valve d24.

In every case, the shuttle valve has a single out single and two in singles.

The release pilot valve c17 is for automatic operation of the release valve d24 for releasing the down pressure air so that the heavy parts can be carried upward against the force of gravity by the vertical movement cylinder 2600. This in turn releases the clamping action so that the drawer can be removed from the machine as earlier described.

Figure 16:
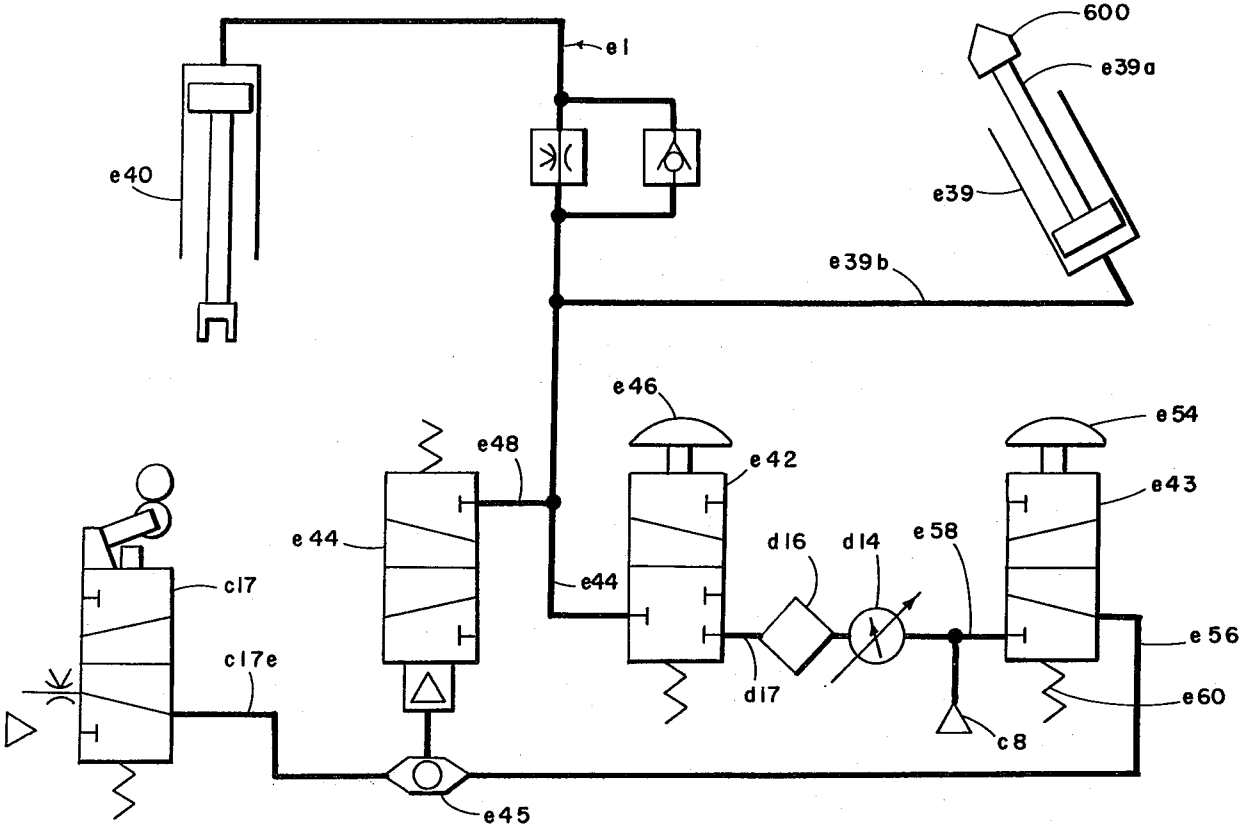
FIG. 16 is an air circuit for control of the drawer bottom engaging cylinders and of the vertical movement balancing cylinders.

Referring now to FIG. 16, a back block circuit e1 is there generally indicated and there is one such circuit per machine, even though there are two back blocks 600, one on the left and one on the right, as the machine is viewed from the front in FIG. 1 and these are seen in a diagram FIG. 10 as being useful for supporting the back panel of the drawer 454, the back blocks 600 having been described earlier as being needed where there is not a stair-step notch in the side panels of the drawer and particularly needed in the FIG. 4 type of drawer which illustrates this.

The back block 600 can, therefore, be seen in FIGS. 10, 24, 1, and can be seen from another view in FIG. 9*a*.

FIG. 16 is a composite view because there are two alternate styles of back block in FIG. 16. The back block that has been previously described at 600 is seen in the upper right in FIG. 16, but there is also a possibility of another type of a back block connection which is not fully illustrated in FIG. 16 and is not important enough to illustrate, suffice it to say that it operates from an air cylinder lever d40 shown in FIG. 16 which has its piston emerging from its lower end whereas the air cylinder system e39 of FIG. 16 has its plunger emerging from its upper end at e39a connecting it to the back block 600. Pressure for the back block cylinder 39 for raising the back blocks 600 comes through a line e39b from either of two sources, one source being automatic, one manual.

Pressure for the line e39b is controlled for input by an in-button valve e42, which has its outline connected to the line e39b.

The line c8 of FIG. 20 leads to a regulator d14 which is also seen in FIG. 15, since the same regulator is used for the circuits of FIGS. 15 and 16. The regulator d14 leads to the lubricator d16 and from there a line d17 that in FIG. 15 leads to the down button valve of d20; also leads in FIG. 16 to the line d17 for delivering air pressure thereto.

Pressure from the in-button valve e42 goes out a line to the line e39b for causing the air cylinder e39 to expand for raising the raising the back box 600 only at times when the in-button of the in-button valve e42 is pushed at e46 for depression. The air pressure signal just described is trapped in the line between the in-button valve e42 and the piston of the air cylinder e39 and, therefore, holds the back box 600 in its upper position against the force of gravity.

There are two ways in which the back blocks 600 could be lowered, one of them is by dumping air through a line e48 from the line e44a, exhausting from the release valve e44 to the atmosphere, all as controlled mechanically by a shuttle valve e45 connected to the release valve e44. The shuttle valve e45 is self-controlled in either of two ways. One of the ways is by a manual valve e43, which has a button e54, which when manually depressed by the operator causes air to flow out of the out-button valve e43 through a line e56 to the shuttle valve e45 for controlling it in a fashion to cause air release from the release valve e44.

The supply air for the button valve e43 comes from the line c8 to a line e58, all as seen in FIG. 15.

The button valve e43 is typical of all button valves in this circuit, since each has a spring, in this case a spring e60 for automatic return of the plungers e54 to its undepressed state.

The other way of operating the shuttle valve e45 is by means of a release pilot valve c17 earlier described, and which is the same as used in the circuits of FIGS. 14 and 15. It is the line c17e, earlier described, which is the out line from the pilot valve c17 that leads to the other side of the shuttle valve e45, whereby operation of the release pilot valve c17 allows air to escape from the release valve e44 and allows the back box 600 to lower.

Pressure for the in line d17 of the in-button valve e42 comes from the line c8 through a down pressure regulator d14, earlier described, through a lubricator d16, earlier described.

Figure 17:
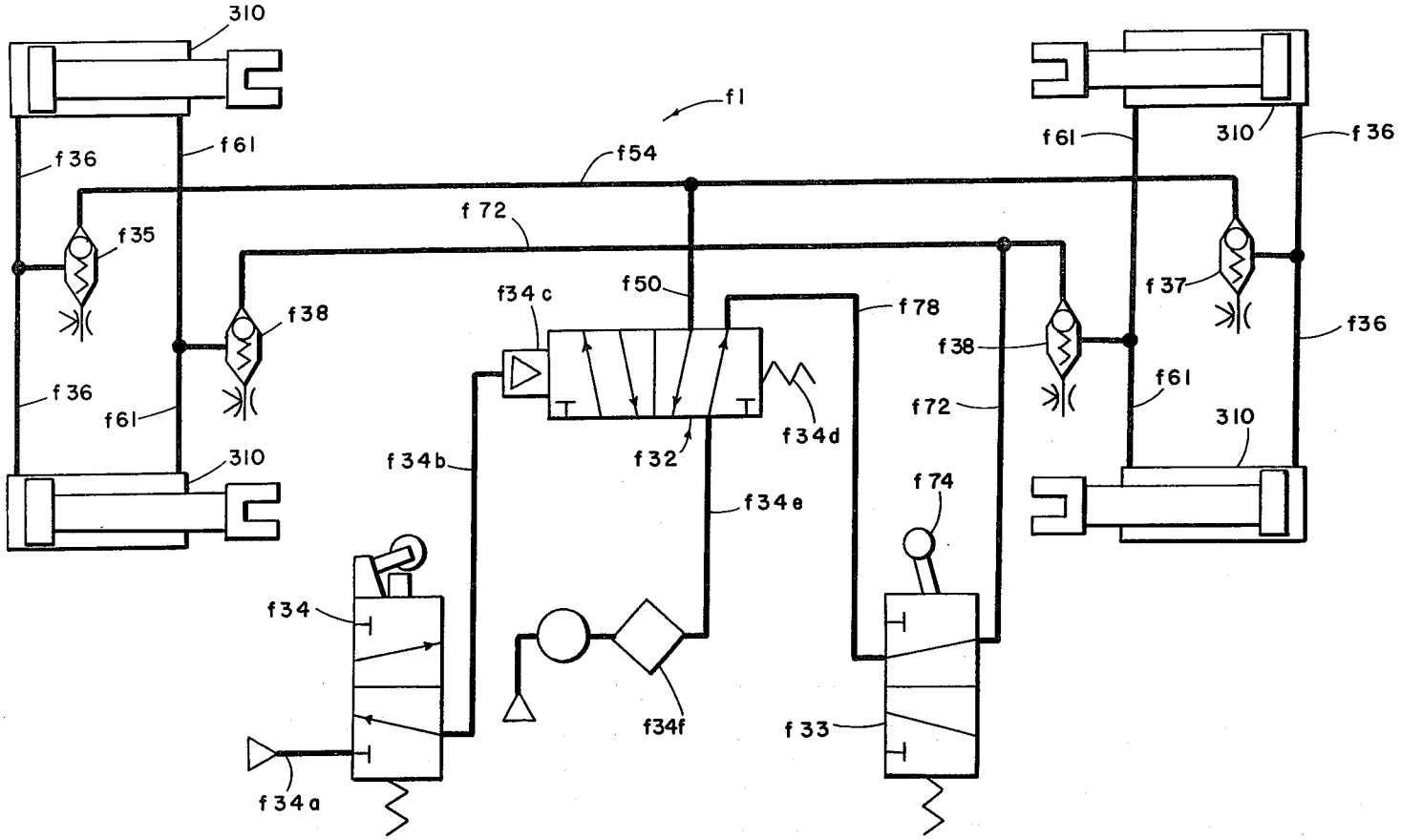
FIG. 17 is the circuit for control of the X-axis movement control cylinders.

Referring now to FIG. 17, the shifting circuit of this invention is there shown at f1 and the same single shifting circuit operates for a cylinder 310 which can be seen in FIGS. 2 and 3. The shifting circuit is operated from the automatic timer. There is no manual control. On the left side of FIG. 17, and on the upper left of FIG. 20 a shifting pilot valve f34 is shown, which latter receives its pressure from a source f34a, and the outside of the shift pilot valve f34 is a line f34b, leading to the pilot shift f34c of a four-way shift control valve f32, which latter is automatically spring returned by a spring f34d whenever there is not pressure signal through f34c.

The shift control valve f32 receives the input pressure line f34e from the regular 2602, earlier described, through a lubricator at 34*f*.

On a four-way valve such as the shift control valve f32 there is always pressure on one side of the valve or the other, one side being the spring return f34d side and when the pilot is against the spring pressure air is shut off from one side and air is delivered from the other side. Since on a four-way valve, it is necessary to exhaust air opposite the pressure to get the motion, each port in turn then becomes an exhaust.

So the shift cylinders 310 are all simultaneously held in respective first positions without a signal at f34c and automatically air is being admitted through line f36 to the other side of the cylinders so that they all extend at the same time.

An additional control is made available, one each for the four cylinders, as seen at f35, f36, f37 and f38, the latter four items being called quick exhausts with speed control, which is a flow control, allowing the cylinders to be independently manually adjusted in advance of drawer building for equalized movement of the four in unison.

At a time of air out-flow through the line f50 to the line f54 the valves f35 and f37 will be in positions for passage of air to the rearward side of the cylinders 310 and at such times no air will exhaust from the valves f35 and f37. Conversely, when the lines f54 and f50 are delivering air to the shift control valve f32, then air will be flowing out from the cylinders 510 at their outer ends through lines f61 and will be exhausting through the quick exhaust with speed control valves f36 and f38, because the latter two valves are not being pressurized at that time through a line f72 which receives its pressure from a shift release valve f33, which is a shut-off valve, spring loaded and manually operated by a lever f74.

When the lever f72 is in one position the valve f33 is open to permit flow through the line f72 from the inside of the shift release valve f33 which is a line f78 leading from the shift control valve f32.

The purpose of the shift release valve f33 is to release all air pressure on all four cylinders 310 so that they can be manually shifted for adjustment.

Figure 18:
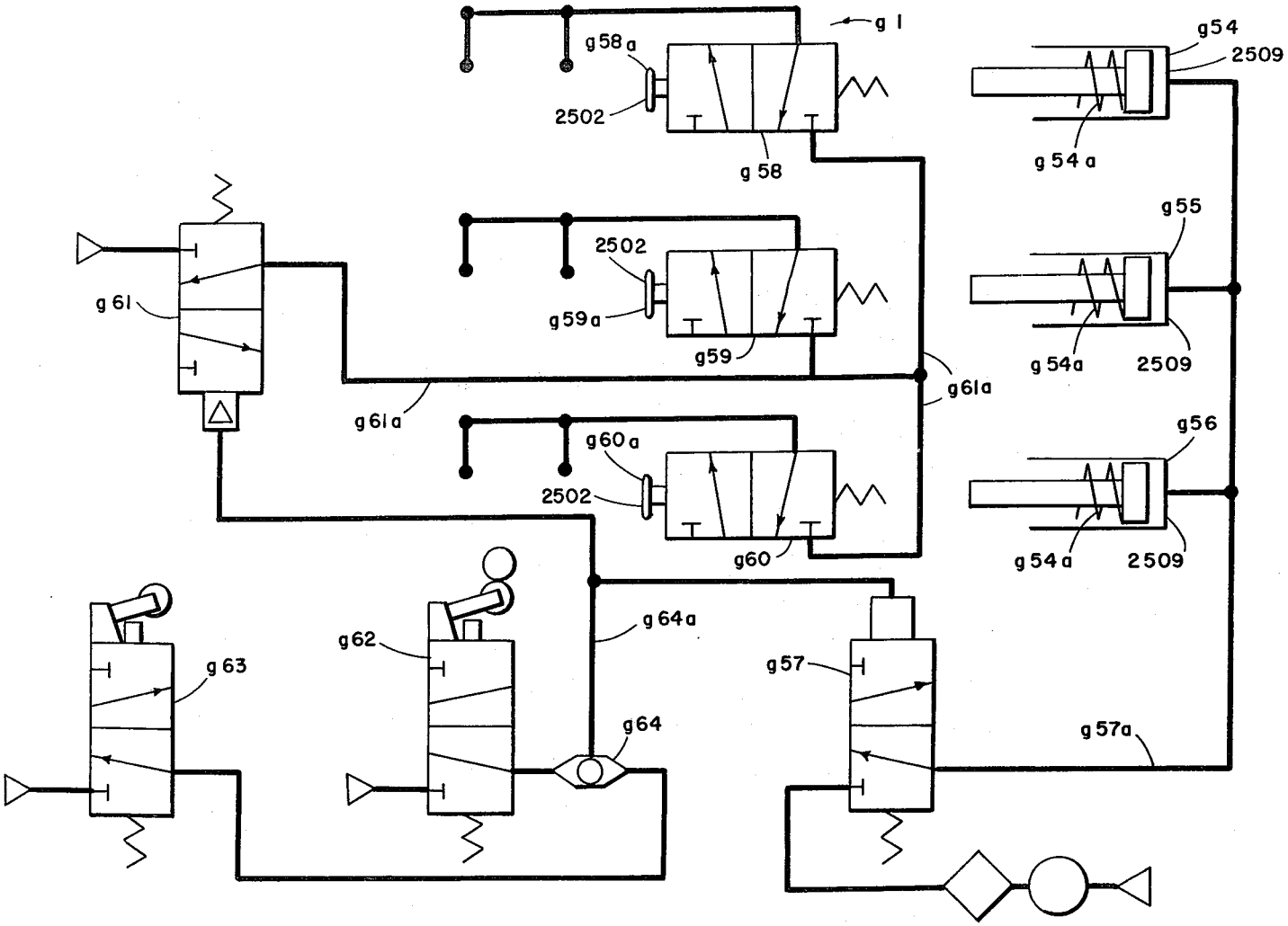
FIG. 18 is the circuit for control of the probe cylinders and the triggering valves.

Referring to FIG. 18 the firing system circuit of this invention is there generally indicated at g1. Because there are two separate firings of the various guns there are, therefore, two separate firing pilot valves g63, g62 occur.

In the entire machine there are three probe cylinders g54, g55 and g56 and when these cylinders are expanded they urge three trigger valves g58, g59 and g60 towards a drawer side piece, such that when the probes g58a and g59a and g60a of the triggering valves g58, g59 and g60, respectively, have made contact with a side of a drawer, then certain actions occur that will be later described.

When air is admitted from a shuttle valve g64 through a line g64a to the respective probe cylinder valve g57 and trigger supply valve g61, then the probe cylinder valve g57 will deliver pressure up to a line g57a for causing the triggering valves g58, g59 and g60 to be moved by their probe cylinders into a position for contacting a side of the drawer, as earlier described. Such contact is specifically made by probe tips 2502 in each case, as earlier described.

The cylinders g54, g55 and g56 bear those labels for convenience of understanding, because they are in FIG. 18. The cylinders are also labeled 2509 because FIG. 1 labels them as 2509. So there is a family of cylinders 2509 which specifically are given numerals g54, g55 and g56.

Simultaneously when air flows through the line 54*a* it will cause the trigger supply valve d61 to deliver air out through line g61a to inside of the triggering valves g58, g59 and g60, whereby when any one of the probe tips 2502 is in contact with a drawer side (they will not always be because some drawer sides are smaller) this causes causes an air signal to be delivered out of the triggering valves g58, g59 and g60 to respective guns.

Each triggering valve controls a bank of guns. Each bank of guns is located in a vertical plane so there are three vertical planes involved, each vertical plane having four guns in it, and each vertical plane being successively farther away from an operator and farther toward the rear of the machine itself. All as described in FIG. 27 and further described in FIG. 25.

It is to be understood that each of the probe cylinders 2509 is spring returned and the springs are seen at g54a, respectively, in FIG. 18.

Figure 19:
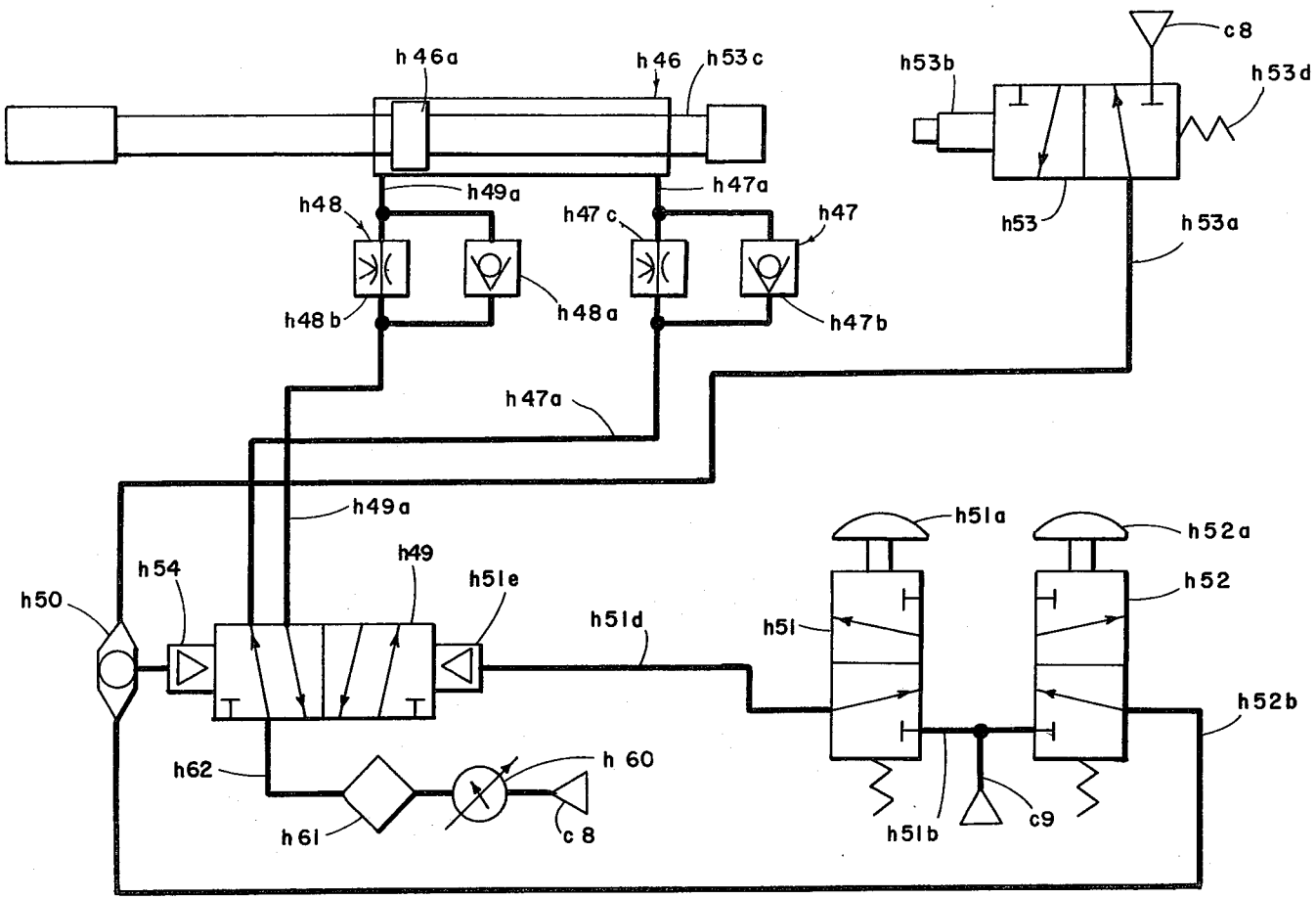
FIG. 19 is the circuit for the control of the timing cylinder.

Referring now to FIG. 19 and also to FIGS. 20, 21 and 22, but first to FIG. 19, this timing cycle for the fastening of the parts of the drawer is started by a button valve h51, having a button h51a which is manually depressed, admitting manifold air at an in-line h51b from a manifold airline c9. The button valve h51 can be found in FIG. 22. The air emitting from the button valve h51 passes through a line h51d to a timer control valve h49.

The timer control valve h49 is a four-way valve and is useful for pressing the piston h46a of a timing cylinder h46 in each of two directions in accordance with how the valve h49 is operated.

The timer control valve h49 receives pilot air through the line h51b from the button valve h51a and when it does it delivers air out of line h49a to the left side of the timing cylinder h46 by means of passing through a check valve h48a which is connected in parallelism with a speed control h48, which latter is useful for compelling the speed of air exiting from the left end of the timing cylinder h46.

A speed control h47 in a line h47a controls the speed of operation of the timing cylinder as its piston is moved toward the left in FIG. 19, resultant from a bleeding off of pressure from the left end of the cylinder. This is done so as to give a very gradual piston travel.

If the timing cylinder h46 were not pneumatic, but hydraulic, then the same amount of flow would necessarily go in on one side of the piston that comes from the other side of the piston. But with a pneumatic cylinder it is possible to bring about a balance in the air pressure on both sides of the piston, and then thereafter to bleed off pressure from only one side, depending upon the expansion of the air on the other side of the piston to permit the piston to move in the direction in which the air is being bled off.

Since such a bleed-off of air is adjustable, it is then possible to increase or decrease the piston travel speed. This adjustment of the bleed-off of air is done by speed controls h47 and h48. The speed control h47, for example, has a check valve h47b in the line h47a and in addition has a manual orifice valve h47c leading to the atmosphere, the valve h47c being disposed in a parallel line circuit with the check valve h47b so that the line h47a can be a supply to the timing cylinder h46 when the orifice valve h47c is closed and the speed control check valve h47b is automatically opening to permit flow to the timing cylinder h46. Flow through the line h49a likewise can be in two directions, either through the check valve h48a when manual h48b is closed as flow goes to the cylinder h46, or out from the left side of the cylinder h46 through the line h49a to the atmosphere through the manually variable exhaust control valve h48b.

It is not necessary to shut off the manual variable exhaust control valve h47c and h48b because they are needle valves and they can be continually left open once they are adjusted to the right size. This is because the amount of air rushing through, at times when air can flow through the check valves h47b and h48a, is sufficient to supply the cylinder h46, even though some does bleed off at the timer control valve h49 by reaching the valve h49 through the exhaust control orifice valves h47c and h48b.

When the button valve h51 is operated, then a pilot at h51e between the line h51d and the timer control valve h49 causes the timer control valve h49 to operate in a manner for delivering air out through the line 47*a* through the check valve h48a whereby the piston h46a is urged to the right. The speed of this movement to the right is controlled by the out-flow valve h47c of the right speed control h47 and because the valve at h47b is a check valve no flow can go through it. Therefore, the flow is slow because it is a tiny needle valve at h47c which, like valve h48b, is not an outlet valve to atmosphere, but instead it is an in-line needle valve and delivers air through the line 147*a* to atmosphere by way of the timer control valve h49.

Pressure air for the valve h49 is received from the manifold line c8, in FIG. 20, through a regulator 60 and then through a lubricator h61, then through a line h62 to the timer control valve h49 and from there through line h47a.

The timer control valve h49 is a four-way spool valve and when the spool is in one position flow goes through one outlet port and the exhaust to atmosphere is at one exhaust port and when the spool is in the opposite position flow goes out a second outlet port and the exhaust is then shifted to a second exhaust port.

The signal to shift the spool of the timer control valve h49 is controlled through a line h53a, coming out from a return pilot valve h53, which latter has a mechanical plunger h53b which faces the piston rod h53c of the timing cylinder h46, whereby the piston h53c, when moved to the right far enough, presses on the plunger h53b operating the return pilot valve h53 against its spring h53d, so as to cause air to flow through the return pilot valve h53 from a manifold line c8, seen in FIG. 20, so as it flows out through the line h53a down to a shuttle valve h50, which operates a pilot h54, causing the timer control valve spool of the valve h49 to shift to its original position admitting air to the right side of the timing cylinder h46, causing the piston h46a to move slowly to the left as the needle valve h48b permits slow flow through the line h49a to the atmosphere through the timer control valve h49.

For emergency stop a manual stop valve h52 is provided having a manual operated button h52a, which, when depressed, causes out-flow through a line h52b to the shuttle valve h50, operating it in identical fashion as flow from the return piloe valve h53 does, except manually. In-flow to the valve h52 is from the line c9 from the manifold.

The purpose of the manual valve h52 is to stop the timer action before a stroke of the timing cylinder h46 is completed so that it is returned to its original position in case something goes wrong with the cycle and the operator later detects that he should stop the operation and correct the problem.

I claim:

1. A building machine in combination with a vertically oriented drawer, said drawer comprising a drawer front, two vertical drawer side pieces, a drawer bottom and a drawer back, said machine comprising first and second carriages mounted on a frame in a manner for relative movement with respect to each other so as to be closer or farther from each other, said relative movement being along a first axis, primary and secondary sub-carriages movably mounted respectively on said first and said second carriages and moveable in parallelism with a second axis at a right angle to said first axis, there being a drawer space between said carriages during building, fastening guns, first and second sets of shiftable gun holders carrying said guns and disposed on right and left sides of the drawer space, there being a third axis disposed at a right angle to said first axis and also at a right angle to said second axis, the gun holders each being spaced apart with respect to other gun holders of the same set substantially along lines parallel to said third axis, the gun holders being moveably mounted on the carriages for movement in directions parallel to said third axis whereby three dimensional adjustment of the position of each of the guns is possible, means for supporting said drawer front in a horizontal position, said machine having means for pressing said vertical drawer side pieces downwardly against said drawer front when said drawer front is in said horizontal position, said vertical drawer side pieces being upstanding from said drawer front when pressed by said means for pressing, said fastening guns comprising right and left fastening guns having their noses closely adjacent right and left outer sides respectively of the drawer side pieces when said drawer side pieces are upstanding from the drawer front, said guns each fastening in at least a partially horizontal direction, said drawer bottom being inserted between the means for pressing, between said fastening guns and between said drawer side pieces whereby the drawer bottom is insertable vertically downwardly when said means for pressing presses the vertical side pieces downwardly against the drawer front and the noses of the fastening guns are closely adjacent the outer sides of the drawer side pieces.

* * * * *